US008548367B2

(12) United States Patent
Baba et al.

(10) Patent No.: US 8,548,367 B2
(45) Date of Patent: Oct. 1, 2013

(54) FIXING DEVICE AND IMAGE FORMING APPARATUS

(75) Inventors: Motofumi Baba, Kanagawa (JP); Yasuhiro Uehara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 290 days.

(21) Appl. No.: 13/163,294

(22) Filed: Jun. 17, 2011

(65) Prior Publication Data

US 2012/0093547 A1 Apr. 19, 2012

(30) Foreign Application Priority Data

Oct. 14, 2010 (JP) ..... 2010-231887

(51) Int. Cl.
*G03G 15/20* (2006.01)

(52) U.S. Cl.
USPC ..... 399/330; 399/122; 399/67; 399/307

(58) Field of Classification Search
USPC ..... 399/122, 67, 307, 330
See application file for complete search history.

(56) References Cited

U.S. PATENT DOCUMENTS 6,978,110 B2 12/2005 Nakayama
7,079,801 B2 7/2006 Nakayama
7,706,733 B2 * 4/2010 Pearce et al. ..... 399/307
8,165,498 B2 * 4/2012 Hoshino et al. ..... 399/121
2003/0095818 A1 5/2003 Nakayama
2005/0244199 A1 11/2005 Nakayama
2008/0219728 A1 * 9/2008 Lee et al. ..... 399/330

FOREIGN PATENT DOCUMENTS

JP 07-281549 A 10/1995
JP 2003-084591 A 3/2003
JP 2003-084605 A 3/2003
JP 2003-114586 A 4/2003
JP 2003-186322 A 7/2003

* cited by examiner

*Primary Examiner* — Walter L Lindsay, Jr.
*Assistant Examiner* — Roy Y Yi
(74) *Attorney, Agent, or Firm* — Sughrue Mion, PLLC

(57) ABSTRACT

A fixing device includes a fixing member that is rotatably provided and heats an image formed on a recording material to fix the image to the recording material, a contact member that moves the recording material by being rotationally driven while coming into contact with the fixing member, and is provided to be separated from the fixing member, and a rotating member that is mounted on the contact member, is disposed to come into contact with the fixing member while the contact member is separated from the fixing member, rotates while interlocking with the contact member, transmits a rotational driving force from the contact member to the fixing member, and rotates with respect to the contact member when the fixing member is rotated by an external force and a rotational driving force is transmitted to the rotating member from the fixing member.

12 Claims, 20 Drawing Sheets

60
61
64
99
94
93
CL
62C
62K
N
62
62A
62J
62B

S

K
SB
SA

FIXING DEVICE AND IMAGE FORMING APPARATUS

CROSS-REFERENCE TO RELATED APPLICATION

This application is based on and claims priority under 35 USC 119 from Japanese Patent Application No. 2010-231887 filed on Oct. 14, 2010.

BACKGROUND

Technical Field

The present invention relates to a fixing device and an image forming apparatus.

SUMMARY

According to an aspect of the invention, there is provided a fixing device including:

a fixing member that is rotatably provided and heats an image formed on a recording material to fix the image to the recording material;

a contact member that moves the recording material positioned between the fixing member and the contact member by being rotationally driven while coming into contact with the fixing member, and is provided so as to be separated from the fixing member; and a rotating member that is mounted on the contact member, is disposed so as to come into contact with the fixing member while the contact member is separated from the fixing member, rotates while interlocking with the contact member, transmits a rotational driving force from the contact member to the fixing member, and rotates with respect to the contact member when the fixing member is rotated by an external force and a rotational driving force is transmitted to the rotating member from the fixing member.

BRIEF DESCRIPTION OF THE DRAWINGS

Exemplary embodiments of the present invention will be described in detail based on the following figures, wherein.

DETAILED DESCRIPTION

Exemplary embodiments of the invention will be described in detail below with reference to accompanying drawings.

<Description of Image Forming Apparatus>

Figure 1:
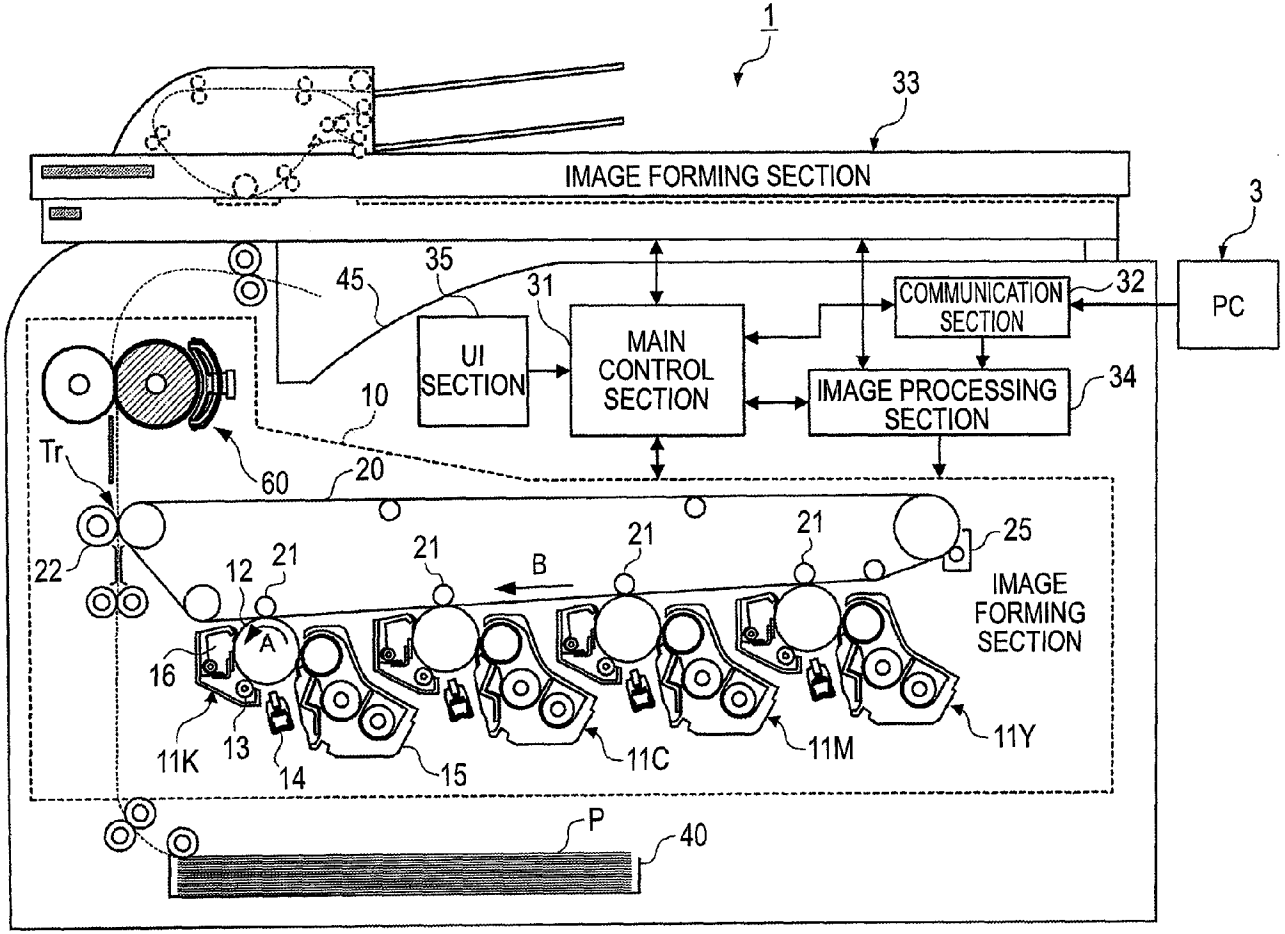
FIG. 1 is a view showing an example of an image forming apparatus.

FIG. 1 is a view showing an example of an image forming apparatus 1. The image forming apparatus 1 is a so-called tandem type color printer. The image forming apparatus 1 includes an image forming section 10 that forms images on the basis of image data, and a main control section 31 that controls the operation of the entire image forming apparatus 1. In addition, the image forming apparatus 1 includes a communication section 32, an image reading section 33, an image processing section 34, and a user interface (UI) section 35. The communication section 32 receives image data through the communication with, for example, a personal computer (PC) 3 or the like. The image reading section 33 reads an image from a document and creates read image data. The image processing section 34 performs predetermined image processing on image data received by the communication section 32, the read image data created by the image reading section 33, and the like; and sends the image data to the image forming section 10. The UI section 35 receives an operation input by a user, and displays various kinds of information to a user.

The image forming section 10 is a section that forms images by, for example, an electrophotographic method, and includes four image forming units 11Y, 11M, 11C, and 11K (hereinafter, referred to as "image forming units 11") that are disposed in parallel. Each of the image forming units 11 includes, for example, a photoreceptor drum 12, a charger 13, an exposure unit 14, a developing unit 15, and a cleaner 16 as functional elements. While the photoreceptor drum 12 rotates in the direction of an arrow A, an electrostatic latent image is formed on the photoreceptor drum 12 and a toner image is then formed on the photoreceptor drum 12. The charger 13 uniformly charges the surface of the photoreceptor drum 12 with a predetermined electric potential. The exposure unit 14 exposes the photoreceptor drum 12, which has been charged by the charger 13, on the basis of image data. The developing unit 15 develops the electrostatic latent image, which is formed on the photoreceptor drum 12, by each color toner. The cleaner 16 cleans the surface of the photoreceptor drum 12 after transfer. The image forming units 11 have substantially the same structure except for toner stored in the developing units 15, and form yellow (Y), magenta (M), cyan (C), and black (K) toner images, respectively.

Further, the image forming section 10 includes an intermediate transfer belt 20 and primary transfer rollers 21. The respective color toner images, which are formed on the photoreceptor drums 12 of the respective image forming units 11, are multiply transferred to the intermediate transfer belt 20. The primary transfer rollers 21 sequentially transfer (primarily transfer) the respective color toner images, which are formed by the respective image forming units 11, to the intermediate transfer belt 20. Furthermore, the image forming section 10 includes a secondary transfer roller 22 and a fixing unit (fixing device) 60. The secondary transfer roller 22 collectively transfers (secondarily transfers) the respective toner images, which are superimposed on and transferred to the intermediate transfer belt 20, to a sheet P that is a recording material (recording sheet). The fixing unit 60 fixes the respective color toner images, which have been secondarily transferred, to the sheet P.

The image forming units 11 of the image forming section 10 form yellow (Y), magenta (M), cyan (C), and black (K) toner images by electrophotographic processes using the above-mentioned functional elements, respectively. The respective color toner images, which are formed in the respective image forming units 11, are sequentially electrostatically transferred to the intermediate transfer belt 20 by the primary transfer rollers 21. Accordingly, a composite toner image where the respective color toners are superimposed is formed. As the intermediate transfer belt 20 is moved (in the direction of an arrow B), the composite toner image formed on the intermediate transfer belt 20 is conveyed to a secondary transfer area Tr where the secondary transfer roller 22 is disposed. The composite toner image formed on the intermediate transfer belt 20 is collectively electrostatically transferred to a sheet P that is fed from a sheet storage container 40. After that, the composite toner image, which has been electrostatically transferred to the sheet P, is subjected to fixing processing by the fixing unit 60 and is fixed to the sheet P. Then, the sheet P to which a fixed image has been formed is conveyed to and stacked on a sheet stacking portion 45 that is provided at an ejection section of the image forming apparatus 1.

Meanwhile, toner that adheres to the photoreceptor drums 12 after primary transfer (primary transfer residual toner) and toner that adheres to the intermediate transfer belt 20 after secondary transfer (secondary transfer residual toner) are removed by the cleaners 16 and the belt cleaner 25, respectively. In this way, image forming processing in the image forming apparatus 1 is repeated over several cycles that correspond to the number of sheets to be printed.

<Description of the Entire Structure of Fixing Unit>

Next, the fixing unit 60 according to this exemplary embodiment will be described.

Figure 2:
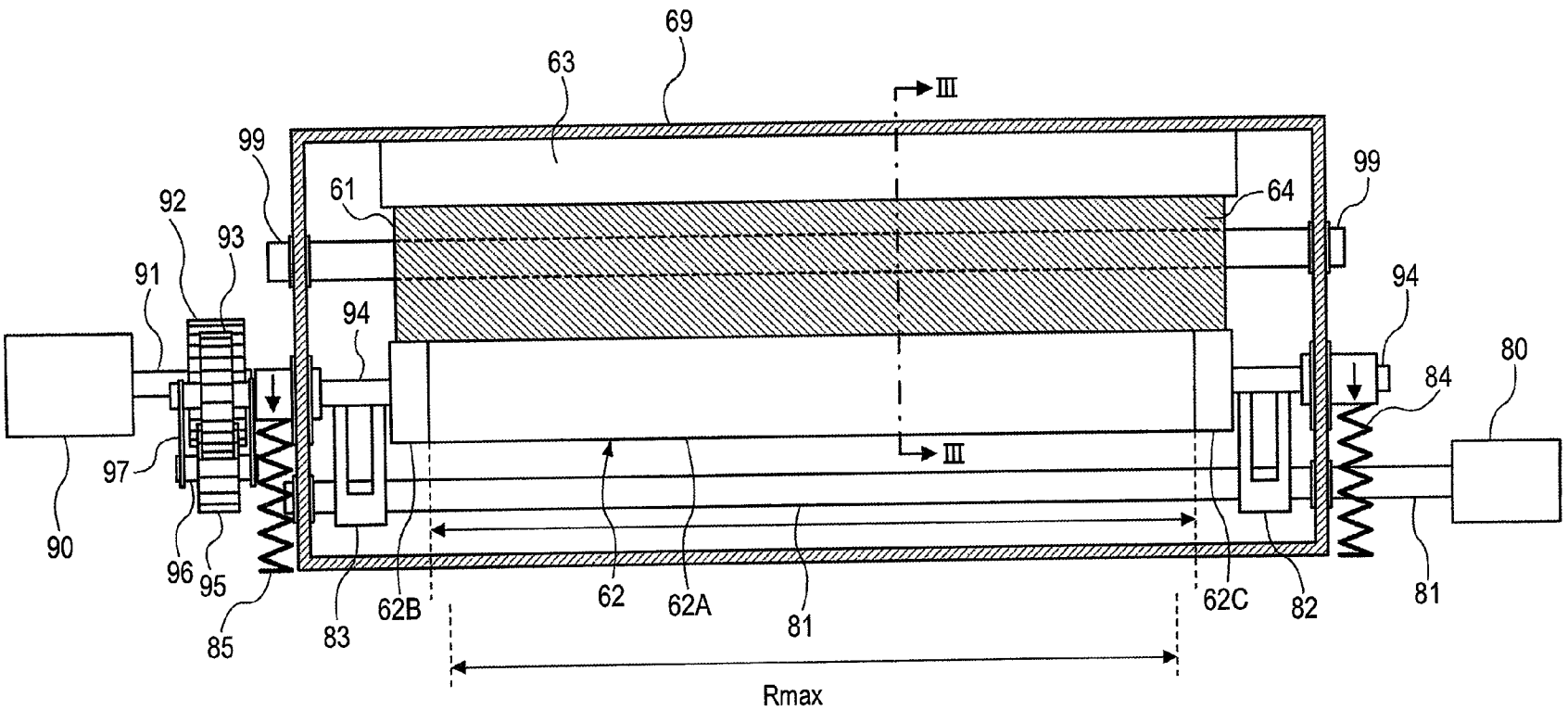
FIG. 2 is a view illustrating the structure of a fixing unit of this exemplary embodiment.
Figure 3:
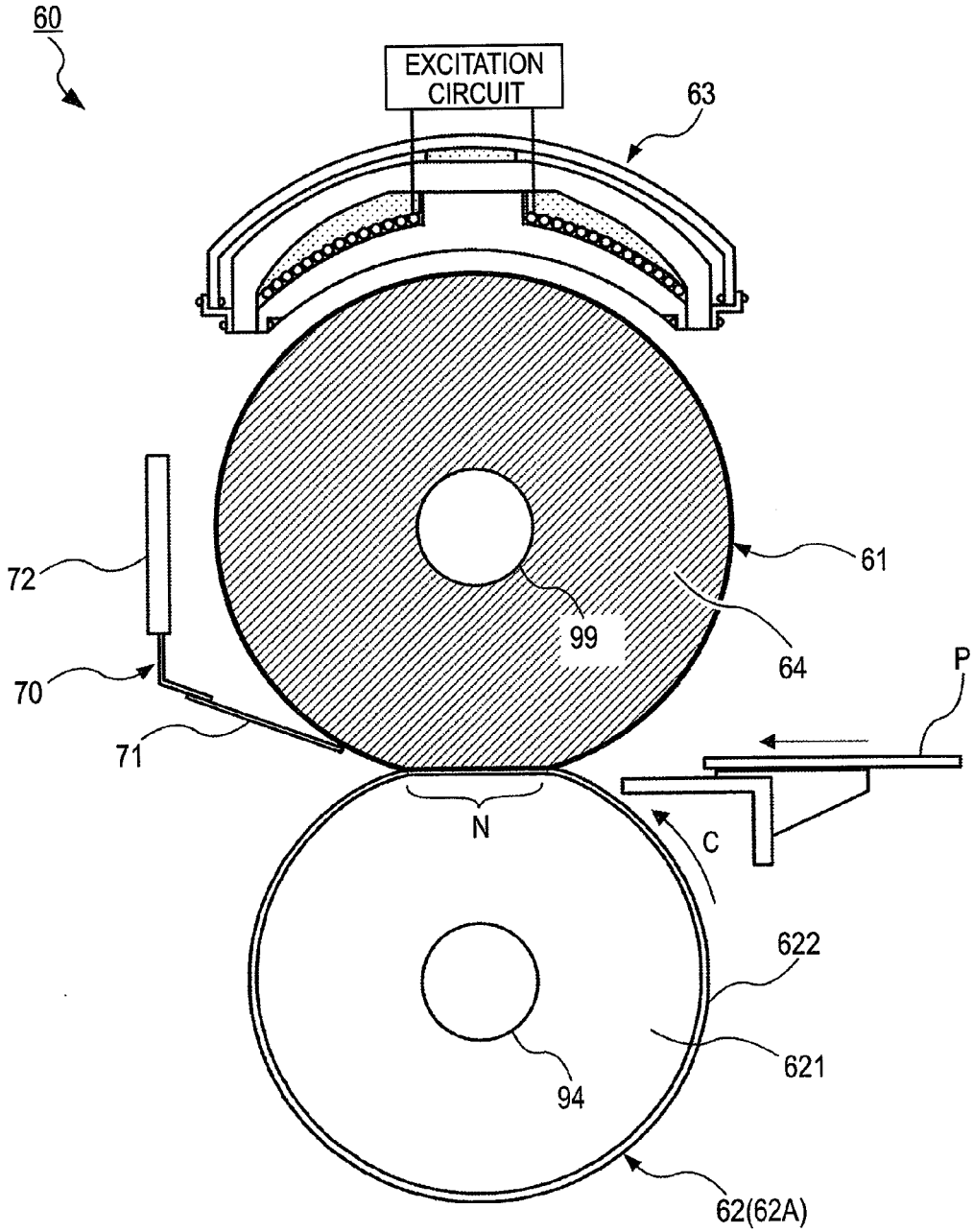
FIG. 3 is a view illustrating the structure of the fixing unit of this exemplary embodiment.

FIGS. 2 and 3 are views showing the structure of the fixing unit 60 according to this exemplary embodiment. FIG. 2 is a front view of the fixing unit 60 when seen from the carrying-in side of a sheet P (the upstream side in the conveying direction of a sheet P), and FIG. 3 is a cross-sectional view taken along a line III-III of FIG. 2.

As shown in FIGS. 2 and 3, the fixing unit 60 includes an IH (Induction Heating) heater 63 that generates an AC magnetic field in a support 69 (see FIG. 2); a fixing belt 61 serving as an example of a fixing member that is heated by electromagnetic induction by the IH heater 63, and heats a toner image formed on a sheet P to fix the toner image to the sheet P; an elastic member 64 that is disposed inside the fixing belt 61; a pressure roller 62 (an example of a contact member) that conveys a sheet P positioned at a nip portion N formed between the fixing belt 61 and the pressure roller by being rotationally driven while coming into contact with the fixing belt 61, and applies pressure to the sheet P; and an auxiliary separating member 70 (see FIG. 3) that assists in separating the sheet P from the fixing belt 61.

<Description of Fixing Belt>

Figure 4:
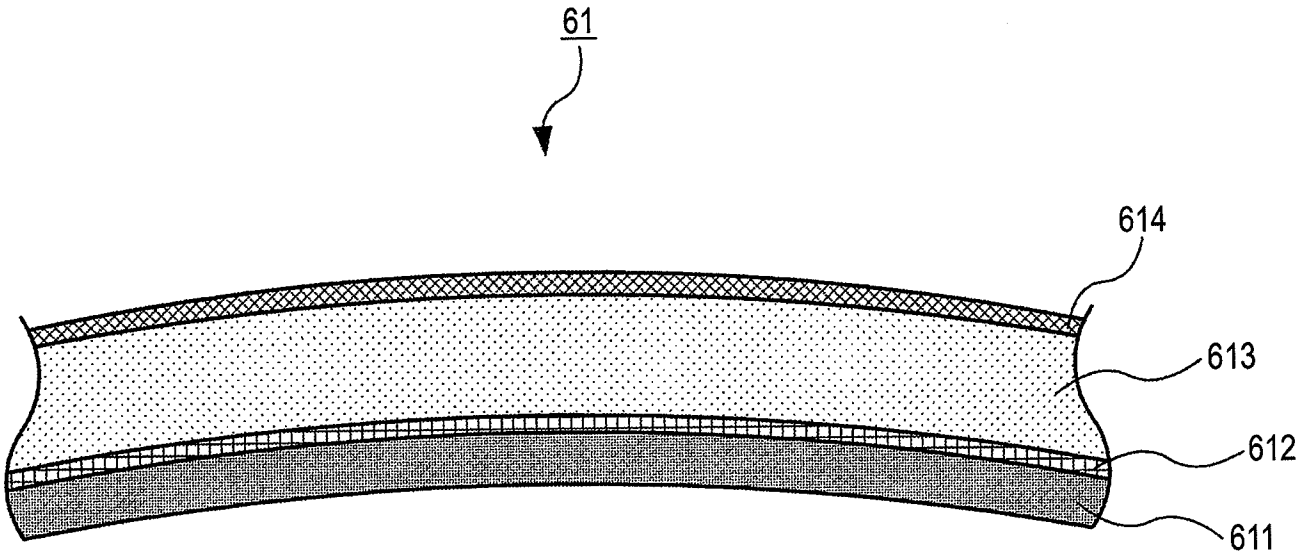
FIG. 4 is a view showing the cross-sectional structure of a fixing belt.

The fixing belt 61 is formed of an endless belt member of which an original shape is a cylindrical shape. When the fixing belt retains its original shape (cylindrical shape), for example, the diameter of the fixing belt is 30 mm and the width of the fixing belt is 380 mm. Further, as shown in FIG. 4 (a view showing the cross-sectional structure of the fixing belt 61), the fixing belt 61 has a multilayer structure that includes a base layer 611, a conductive heating layer 612 stacked on the base layer 611, an elastic layer 613 improving the fixing property of a toner image, and a surface release layer 614 coated as a top layer.

The base layer 611 of the fixing belt 61 supports a thin conductive heating layer 612, and is formed of a heat-resistant sheet-like member that has the mechanical strength of the entire fixing belt 61. Further, the base layer 611 is made of a material having properties (relative magnetic permeability and specific resistance) and a thickness, which allow the passage of a magnetic field, and the base layer 611 itself is formed so that the base layer does not generate heat or hardly generates any heat by the action of a magnetic field. Specifically, for example, a non-magnetic metal such as non-magnetic stainless steel having a thickness in the range of 30 to 200 μm, a resin material having a thickness in the range of 60 to 200 μm, or the like may be used as the base layer 611.

The conductive heating layer 612 of the fixing belt 61 is an electromagnetic induction heating element layer that is heated by electromagnetic induction with the AC magnetic field generated by the IH heater 63. That is, the conductive heating layer 612 is a layer that generates an eddy current when an AC magnetic field generated by the IH heater 80 passes through the conductive heating layer 612 in a thickness direction. Here, the frequency of the AC magnetic field, which is generated by the IH heater 63, is generally in the range of 20 to 100 kHz that corresponds to the frequency of an AC magnetic field generated by a general-purpose power source. Accordingly, the conductive heating layer 612 is formed so that an AC magnetic field having a frequency in the range of 20 to 100 kHz penetrates and passes through the conductive heating layer.

For example, metals, such as Au, Ag, Al, Cu, Zn, Sn, Pb, Bi, Be, and Sb, or metal alloys thereof are used as the material of the conductive heating layer 612. Specifically, a non-magnetic metal (which is a paramagnet having a relative magnetic permeability of substantially 1), such as Cu, which has a thickness in the range of 2 to 20 μm and a specific resistance of $2.7\times10^{-8}$ Ω·m or less, is used as the conductive heating layer 612. Moreover, even in terms of the reduction of the time (hereinafter, referred to as "warm-up time") that is required to heat the fixing belt 61 to a fixing temperature, the conductive heating layer 612 is formed of a thin layer so that a heat capacity is low.

The elastic layer 613 of the fixing belt 61 is formed of a heat-resistant elastic body such as silicone rubber. A toner image held on a sheet P, which is an object to which an image is fixed, is formed by stacking the respective color toners that are powders. Accordingly, in order to uniformly supply heat to the entire toner image at a nip portion N, the elastic layer 613 is formed so as to be deformed according to the unevenness of the toner image held on the sheet P. For example, silicone rubber, which has a thickness in the range of 100 to 600 μm and a hardness in the range of 10 to 30° (JIS-A), is used for the elastic layer 613.

Since the surface release layer 614 of the fixing belt 61 comes into direct contact with unfixed toner images that are held on the sheet P, a material having a high releasing property with respect to toner is used for the surface release layer. For example, PFA (tetrafluoroethylene-perfluoroalkylvinyl ether polymer), PTFE (polytetrafluoroethylene), a silicone copolymer, a composite layer thereof, and the like maybe used as the surface release layer. If the surface release layer 614 is excessively thin, the abrasion resistance of the surface release layer 614 is not sufficient, so that the life of the fixing belt 61 is shortened. Meanwhile, if the surface release layer 614 is excessively thick, the heat capacity of the fixing belt 61 is excessively high, so that warm-up time is increased. Accordingly, in consideration of the balance between abrasion resistance and heat capacity, it is preferable that the thickness of the surface release layer 614 be in the range of 1 to 50 μm. Meanwhile, the fixing belt 61 may have a single layer structure that is made of a single material. For example, the fixing belt 61 may be formed of a single layer that has a thickness of about 50 μm and is made of metal such as Ni.

<Description of Elastic Member>

In the fixing unit 60 according to this exemplary embodiment, the elastic member 64 is disposed inside the fixing belt 61 over the entire width of the fixing belt 61. The elastic member 64 is formed of a cylindrical roller that has an outer diameter of 30 mm and is made of an elastic body, such as rubber or elastomer (for example, silicone rubber), having a rubber hardness of, for example, 15 to 45° (JIS-A). The elastic member 64 is fixed (joined) to a rotating shaft 99. In addition, the outer peripheral surface of the elastic member 64 adheres to the inner peripheral surface of the fixing belt 61. Accordingly, the fixing belt 61 has a structure where an elastic roller including the rotating shaft 99 and the elastic member 64 is built therein, and is rotationally driven as the rotating shaft 99 rotates.

Meanwhile, the outer diameter of the elastic member 64, which is disposed inside the fixing belt 61, may be slightly larger than the diameter (for example, 30 mm) of the fixing belt 61 that retains its original shape (cylindrical shape). Accordingly, the adhesion between the outer peripheral surface of the elastic member 64 and the inner peripheral surface of the fixing belt 61 is improved. For example, if the outer diameter of the elastic member 64 is set to 31 mm so as to be larger than 30 mm, which is the outer diameter of the fixing belt 61 retaining its original shape, by about 1 mm, the adhesion between the elastic member 64 and the fixing belt 61 is increased by an elastic force applied from the elastic member 64.

When the pressure roller 62 is disposed so as to come into press contact with the fixing belt 61 (the pressure roller 62 is disposed so as to come into contact with the fixing belt 61 while pressing the fixing belt 61) by a contact/separation mechanism to be described below, the fixing belt 61 forms the nip portion N between the pressure roller 62 and itself by elastic forces of both the elastic member 64 and the pressure roller 62 due to this structure. Meanwhile, when the pressure roller 62 is disposed so as to be separated from the fixing belt 61 by the contact/separation mechanism, the original shape (cylindrical shape) of the entire fixing belt 61 is restored. Meanwhile, the functions of the elastic member 64 will be described in detail below.

Further, in this exemplary embodiment, both end portions of the rotating shaft 99 are rotatably supported by the support 69 as shown in FIG. 2. Further, while the pressure roller 62 comes into press contact with the fixing belt 61 by the contact/separation mechanism, the pressure roller 62 comes into press contact with the fixing belt 61 over the entire width of the fixing belt 61. Accordingly, the fixing belt 61 is rotated by the pressure roller 62 with the frictional force that is applied from the entire pressure roller 62. Meanwhile, while the pressure roller 62 is separated from the fixing belt 61, power transmission members 62B and 62C (also see FIG. 5), which are mounted on both end portion areas of the pressure roller 62, come into press contact with the fixing belt in both end portion areas of the fixing belt 61 and the fixing belt 61 is rotated by the pressure roller 62 with the frictional forces that are applied from the power transmission members 62B and 62C. Meanwhile, a mechanism, which drives the fixing belt 61 and the pressure roller 62, will be described in detail below.

<Description of Pressure Roller>

As shown in FIG. 2, the pressure roller 62 includes a roller main body portion 62A. The length of the roller main body portion 62A is larger than the length of a sheet-passing area (maximum sheet-passing area Rmax) of the largest sheet (for example, an A3 sheet), which is to be used in the image forming apparatus 1, in the longitudinal direction of the pressure roller. Further, the power transmission members 62B and 62C (an example of a transmission member and a rotating member), which are provided on both end portion areas of the roller main body portion 62A (the outer areas of the maximum sheet-passing area Rmax), rotate while interlocking with the pressure roller 62, and transmit a rotational driving force from the pressure roller 62 to the fixing belt 61, are provided in this exemplary embodiment. The power transmission members 62B and 62C are formed so that an elastic deformation rate of each of the power transmission members 62B and 62C against the pressure (hereinafter, referred to as "nip pressure") at the nip portion N, which is an area where the pressure roller 62 comes into press contact with the fixing belt 61 (the pressure roller 62 comes into contact with the fixing belt 61 while pressing the fixing belt 61), is larger than that of the roller main body portion 62A against the nip pressure. Here, the "elastic deformation rate" means the amount of the elastic deformation of an object per unit volume when nip pressure is applied to the object.

Further, as shown in FIG. 3, the roller main body portion 62A of the pressure roller 62 includes a heat-resistant elastic body layer 621 and a release layer 622. The heat-resistant elastic body layer 621 is made of, for example, foamed silicone rubber or the like. The release layer 622 has a thickness of, for example, 50 μm, and is formed of a heat-resistant rubber coating or a heat-resistant resin coating such as a carbon-containing PFA. Furthermore, the roller main body portion 62A of the pressure roller 62 is formed to have an outer diameter of 28 mm and an axial length of 370 mm. Accordingly, the length of the entire pressure roller 62, which includes the power transmission members 62B and 62C each having an axial length of 10 mm, has an axial length of 390 mm. Moreover, the entire pressure roller 62 is disposed in parallel with the fixing belt 61 along the rotating shaft 99 of the fixing belt 61, and is adapted to come into contact with and be separated from the fixing belt 61 by the contact/separation mechanism as described below.

Further, as shown in FIG. 2 (also see FIG. 6 to be described below), a rotating shaft 94 is provided at the pressure roller 62 so as to pass through the rotational center of the pressure roller 62. Furthermore, a driving transmission gear 93 is fixed to one end portion of the rotating shaft 94, and the rotating shaft 94 is supported by the support 69 so as to be movable and rotatable within a predetermined range in a direction toward the fixing belt 61. Moreover, the pressure roller 62 receives a driving force from a drive motor 90, which is a drive source, through the driving transmission gear 93, and rotates by itself in the direction of an arrow C shown in FIG. 3. Accordingly, the pressure roller 62 drives the fixing belt 61 so that the fixing belt 61 is rotated. In this case, while pressing the fixing belt 61, the pressure roller 62 forms a nip portion N at a contact position where the pressure roller comes into contact with the fixing belt 61. When a sheet P on which unfixed toner images are held passes through the nip portion N, the pressure roller 62 fixes the unfixed toner images to the sheet P by heat and pressure.

<Description of Longitudinal Structure of Pressure Roller>

Figure 5A:
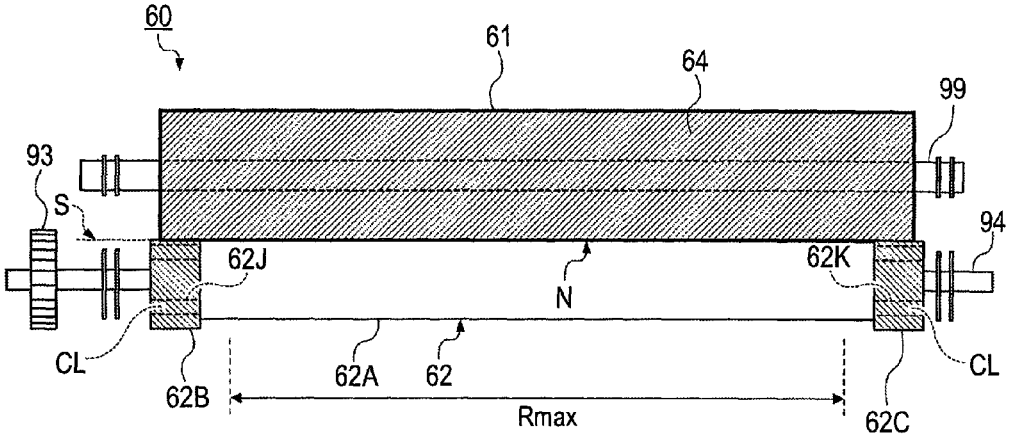
FIGS. 5A and 5B are views illustrating the longitudinal structure of a pressure roller.
Figure 5B:
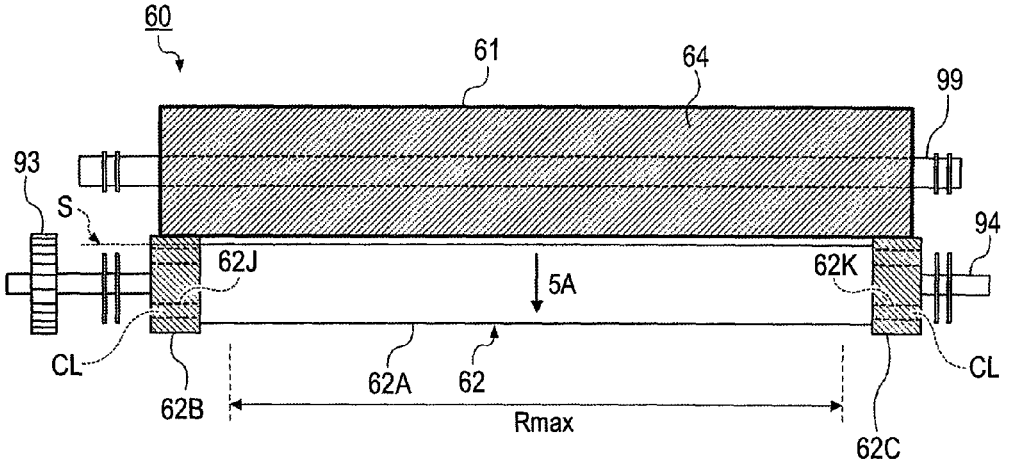

FIG. 5 is a view illustrating the longitudinal (axial) structure of the pressure roller 62. FIG. 5A shows the pressure roller 62 that comes into press contact with the fixing belt 61 by the contact/separation mechanism (hereinafter, referred to as a "retraction mechanism"), and FIG. 5B shows the pressure roller 62 that is separated from the fixing belt 61. Meanwhile, FIGS. 5A and 5B also show the state of the pressure roller when seen from the carrying-in side of a sheet P (the upstream side in the conveying direction of a sheet P).

When the pressure roller 62 comes into press contact with the fixing belt 61 due to the retraction mechanism, as shown in FIG. 5A, the nip portion N (also see FIG. 3) is formed in the pressure roller 62 of this exemplary embodiment by the elastic member 64 that is elastically deformed by a pressing force applied from the roller main body portion 62A of the pressure roller 62 and the roller main body portion 62A that is elastically deformed by a reaction to the pressing force. In this case, the power transmission members 62B and 62C, which are formed so that an elastic deformation rate of each of the power transmission members 62B and 62C is larger than that of the roller main body portion 62A, are pressed against the fixing belt 61, and are compressed up to a surface position that corresponds to a surface position S of the roller main body portion 62A at the nip portion N.

More specifically, each of the power transmission members 62B and 62C is formed in an annular shape, and is made of an elastic body (sponge) that is obtained by foaming, for example, silicone rubber and has a rubber hardness of 15 to 35° (JIS-A). Further, each of the power transmission members 62B and 62C is supported by a one-way clutch CL (an example of a rotating mechanism) that is mounted on each of the power transmission-support portions 62J and 62K having a diameter smaller than the diameter of the roller main body portion 62A. Furthermore, in this exemplary embodiment, the power transmission members 62B and 62C are compressed in spaces that are formed due to the differences between the outer diameter of the roller main body portion 62A elastically deformed by the reaction of the elastic member 64 and the outer diameters of the one-way clutches CL. Accordingly, the surface positions of the power transmission members 62B and 62C correspond to the surface position S of the roller main body portion 62A that is elastically deformed. As a result, the nip pressure at the nip portion N is set to be uniform over the width direction by the balance between the elastic forces of the roller main body portion 62A and the elastic member 64 while being largely unaffected by the power transmission members 62B and 62C even on both end portion areas.

Next, when separating the pressure roller 62 from the fixing belt 61, the retraction mechanism moves the pressure roller 62 to a position where the roller main body portion 62A is separated from the fixing belt 61 and the power transmission members 62B and 62C come into press contact with the fixing belt 61 (the power transmission members 62B and 62C come into contact with the fixing belt 61 while pressing the fixing belt 61) as shown in FIG. 5B. That is, the retraction mechanism moves the pressure roller 62 to a position where the roller main body portion 62A is completely separated from the fixing belt 61 but the power transmission members 62B and 62C come into press contact with the fixing belt 61. Further, when the pressure roller 62 is rotated in the direction of an arrow 5A shown in FIG. 5B (a direction opposite to the rotational direction corresponding to the time of fixing), a rotational driving force is transmitted to the fixing belt 61 from the pressure roller 62 by the frictional forces between the fixing belt 61 and the power transmission members 62B and 62C. Accordingly, the pressure roller 62 rotates the fixing belt 61 while the roller main body portion 62A is completely separated from the fixing belt 61.

<Description of Structure of Power Transmission Section of Pressure Roller>

Figure 6A:
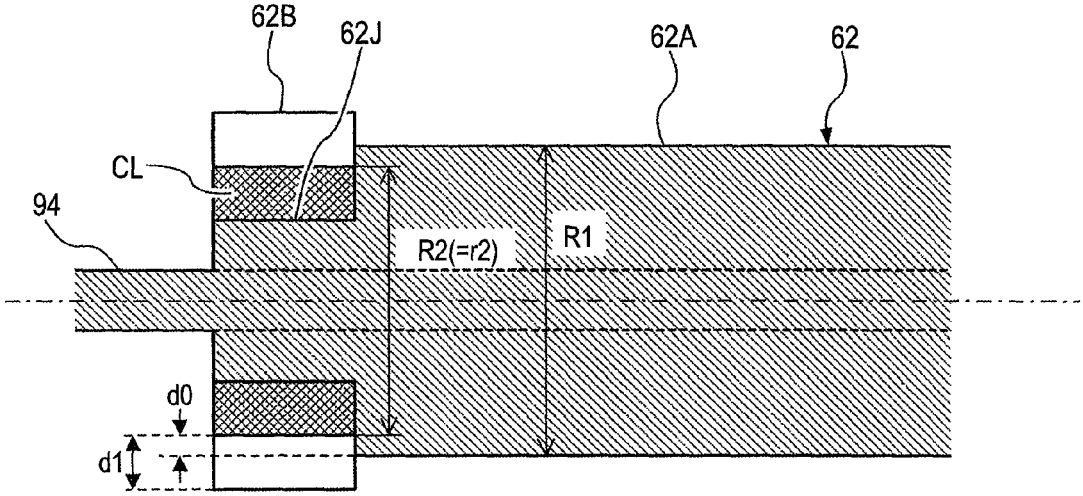
FIGS. 6A and 6B are views specifically showing the structure of the pressure roller.
Figure 6B:
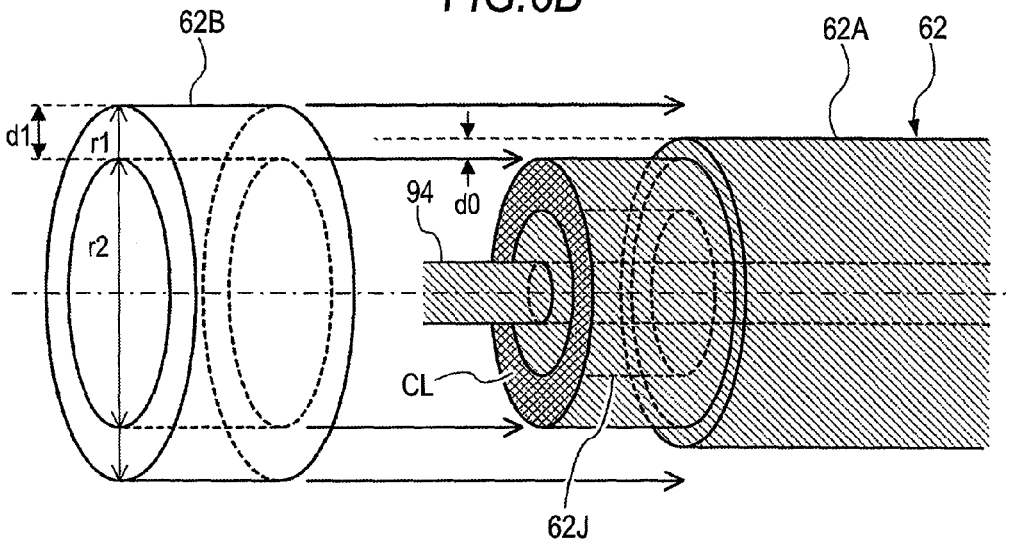

FIG. 6 is a view specifically showing the structure of the pressure roller 62. FIG. 6A is a view showing the cross-sectional structure of the power transmission members 62B and 62C, and FIG. 6B is a perspective view showing the assembly structure of the power transmission members 62B and 62C. Meanwhile, the power transmission member 62B, which is provided at one end portion of the pressure roller, is shown in FIG. 6, but the power transmission member 62C, which is provided at the other end portion of the pressure roller, also has the same structure as the structure of the power transmission member 62B.

In this exemplary embodiment, the one-way clutches CL are fitted around and mounted on power transmission-support portions 62J and 62K, which are formed integrally with the roller main body portion 62A as shown in FIG. 6B, respectively. Further, each of the power transmission members 62B and 62C of this exemplary embodiment is fitted around and mounted on the one-way clutch CL. In other words, the one-way clutch CL is disposed between the roller main body portion 62A and each of the power transmission members 62B and 62C. Further, the power transmission members 62B and 62C are formed so that a thickness d1 (=(r1−r2)/2), which is a half of a difference between the outer diameter r1 (32 mm) of each of the power transmission members and the inner diameter r2 (26 mm) thereof, is 3 mm. Furthermore, the one-way clutches CL, which support the power transmission members 62B and 62C, are formed so that the outer diameter R2 (=r2) of each of the one-way clutches is equal to the inner diameter r2 of each of the power transmission members 62B and 62C, that is, 26 mm as shown in FIG. 6A. Accordingly, a level difference d0, which is a half of a difference between the outer diameter R1 (28 mm) of the roller main body portion 62A and the outer diameter of the one-way clutch CL, is set to 1 mm in the one-way clutch CL.

Meanwhile, when separating the pressure roller 62 from the fixing belt 61, the retraction mechanism is set so that a gap between the roller main body portion 62A and the fixing belt 61 is, for example, 1.5 mm. Accordingly, when the roller main body portion 62A is separated from the fixing belt 61 by the retraction mechanism, the power transmission members 62B and 62C having a thickness d1 of 3 mm come into (press) contact with the fixing belt 61 while being compressed and deformed so as to have a thickness of 2.5 mm that is a sum of the gap of 1.5 mm and the level difference d0 (1 mm). Accordingly, the fixing belt 61 is rotated by the rotation of the pressure roller 62 with the frictional forces caused by the elastic forces of the power transmission members 62B and 62C that are compressed and deformed so that the thickness dl is changed to, for example, 2.5 mm from 3 mm as shown in FIG. 5B. In this case, since the fixing belt 61 does not convey a sheet P, the drive torque required to drive the fixing belt 61 is small, for example, about 0.05 to 0.1 N. For this reason, the fixing belt 61 is rotated with the frictional forces that are based on the elastic forces of the compressed and deformed power transmission members and are applied from the power transmission members 62B and 62C.

Further, when the retraction mechanism makes the pressure roller 62 come into press contact with fixing belt 61, as shown in FIG. 5A, the power transmission members 62B and 62C are compressed in the spaces formed due to the level differences d0 (1 mm), which are formed by the surface position S of the roller main body portion 62A and the outer peripheral surfaces of the one-way clutches CL, and the surface positions S of the power transmission members 62B and 62C correspond to the surface position S of the roller main body portion 62A that is elastically deformed. Accordingly, the nip pressure at the nip portion N is set to be uniform over the width direction mostly by the balance between the elastic forces of the roller main body portion 62A and the elastic member 64.

Meanwhile, a back-up member, which is formed of a thin-wall cylindrical member made of a material having a rigidity higher than the rigidity of the elastic member 64 (a material having an elastic deformation rate lower than the elastic deformation rate of the elastic member 64), may be disposed in the area of the elastic member 64 that is provided inside the fixing belt 61 facing the power transmission members 62B and 62C. Accordingly, the power transmission members 62B and 62C are more reliably elastically compressed with the amount of elastic deformation, which is previously supposed, so as to correspond to a state where the roller main body portion 62A of the pressure roller 62 comes into press contact with the fixing belt 61 due to the retraction mechanism and a state where the roller main body portion 62A of the pressure roller 62 is separated from the fixing belt 61 by the retraction mechanism.

That is, since the back-up member having a high rigidity (having a low elastic deformation rate) receives pressing forces from the power transmission members 62B and 62C, the power transmission members 62B and 62C are apt to be elastically compressed with the amount of elastic deformation that is previously supposed. For this reason, while the roller main body portion 62A comes into press contact with the fixing belt 61, the power transmission members 62B and 62C are more reliably compressed in the spaces formed due to the level differences d0 that are formed by the surface position S of the roller main body portion 62A and the outer peripheral surfaces of the one-way clutches CL. Further, while the pressure roller 62 is separated from the fixing belt 61, the power transmission members 62B and 62C more reliably come into (press) contact with the fixing belt 61 in a compressed and deformed state that is previously supposed.

<Description of Contact/Separation Mechanism for Pressure Roller>

Subsequently, the retraction mechanism (contact/separation mechanism), which moves the above-mentioned pressure roller 62 in a direction where the pressure roller comes into contact with and is separated from the fixing belt 61, will be described.

As shown in FIG. 2, the fixing unit 60 according to this exemplary embodiment includes a rotating shaft 81, a displacement motor 80, and cams 82 and 83, as a retraction mechanism. The rotating shaft 81 is rotatably supported by the support 69. The displacement motor 80 displaces the rotating shaft 81 in a predetermined angular range. The cams 82 and 83 are fixed to the pressure roller 62 at positions facing the rotating shaft 94 in both end portion areas of the rotating shaft 81, and swing by the displacement of the rotating shaft 81. In addition, the fixing unit 60 includes springs 84 and 85 that are connected to both end portion areas of the rotating shaft 94 of the pressure roller 62 and push the pressure roller 62 in a direction where the pressure roller 62 is separated from the fixing belt 61 (in the direction of an arrow).

Figure 7B:
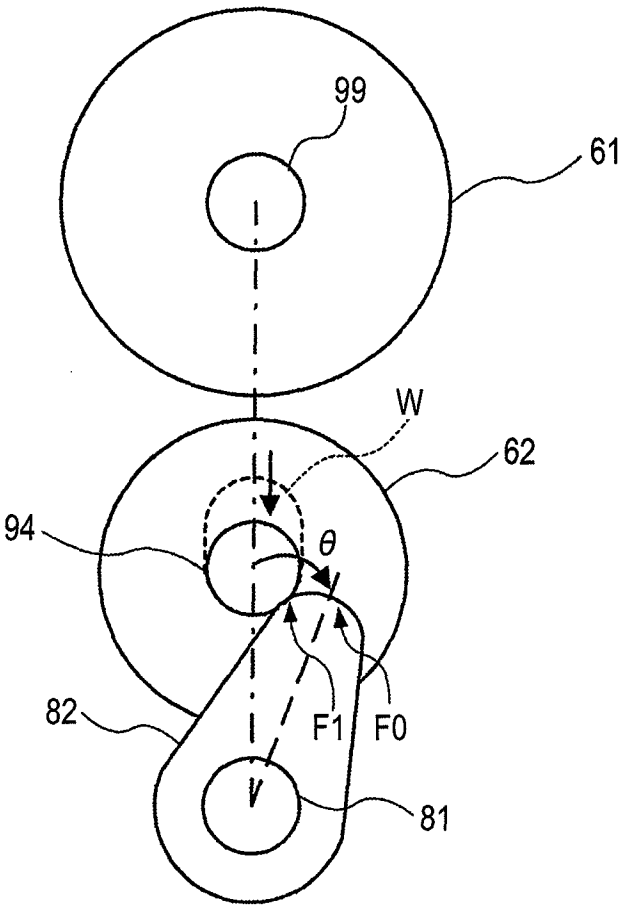
FIGS. 7A and 7B are views illustrating an operation when a retraction mechanism makes the pressure roller come into contact with and be separated from a fixing belt.
Figure 7A:
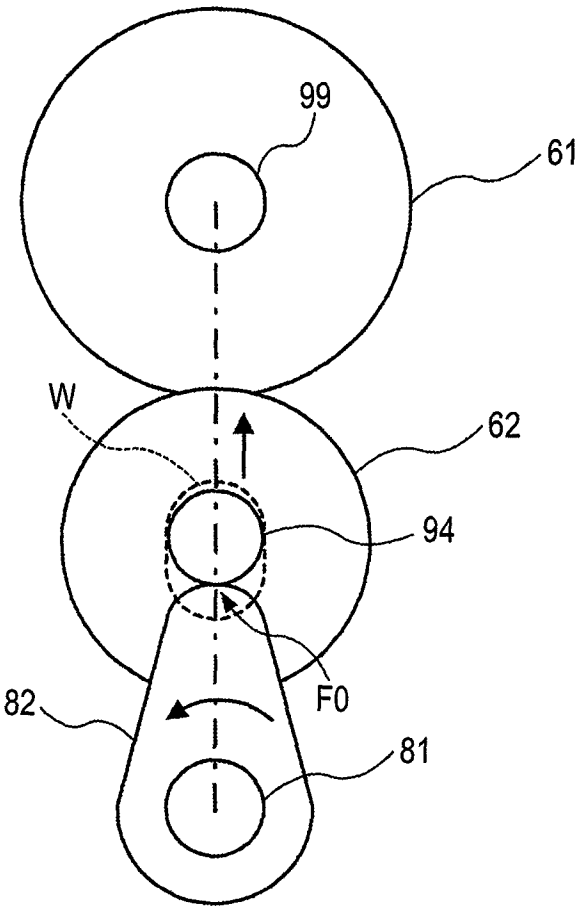

FIG. 7 is a view illustrating an operation when the retraction mechanism makes the pressure roller 62 come into contact with and be separated from the fixing belt 61. First, when the displacement motor 80 displaces the rotating shaft 81 so that a crest FO of each of the cams 82 and 83 (only the cam 82 is shown in FIG. 7) faces the rotating shaft 99 of the fixing belt 61 as shown in FIG. 7A, the crest FO of the cam 82 (cam 83) pushes the rotating shaft 94 of the pressure roller 62 toward the fixing belt 61 (in the direction of an arrow) against the pushing forces of the springs 84 and 85. Accordingly, the pressure roller 62 is set to a position where the roller main body portion 62A presses the elastic member 64 with the fixing belt 61 interposed therebetween.

Subsequently, when the displacement motor 80 displaces the rotating shaft 81 so that the crest F0 of the cam 82 (cam 83) is inclined with respect to the direction toward the rotating shaft 99 of the fixing belt 61 by an angle θ as shown in FIG. 7B, the rotating shaft 94 of the pressure roller 62 is moved within the range of a movement restriction area W, which is set in the support 69, along the side surface F1 of the cam 82 (cam 83) by the pushing forces of the springs 84 and 85 (see FIG. 2) in a direction where the pressure roller is separated from the fixing belt 61 (in the direction of an arrow shown in FIG. 7B). Accordingly, the pressure roller 62 is set to a position where the roller main body portion 62A is separated from the fixing belt 61. Meanwhile, the movement restriction area W, which is set in the support 69, is formed so that a range where the press contact between the power transmission members 62B and 62C of the pressure roller 62 and the fixing belt 61 is maintained, for example, a gap between the roller main body portion 62A and the fixing belt 61 is 1.5 mm when the pressure roller 62 is separated from the fixing belt 61.

As described above, the pressure roller 62 performs a contact/separation operation with respect to the fixing belt 61 by the retraction mechanism. When a fixing operation starts and is ended in the fixing unit 60, the contact/separation operation of the pressure roller 62 is performed by the retraction mechanism. That is, the pressure roller 62 is set so as to come into press contact with the fixing belt 61 (the pressure roller 62 is set to come into contact with the fixing belt 61 while pressing the fixing belt 61) at the start of the fixing operation. Accordingly, the pressure roller 62, which receives the rotational driving force from the drive motor 90 (see FIG. 2), rotates the fixing belt 61 at the time of the fixing operation. Further, the separation between the roller main body portion 62A of the pressure roller 62 and the fixing belt 61 is maintained before the fixing operation, and the fixing belt 61 is rotated in this state. Accordingly, an operation, which heats the fixing belt 61 up to a fixing temperature by the IH heater 63, (hereinafter, referred to as a "warm-up operation") is performed.

<Description of Drive Mechanism for Fixing Belt>

Next, a mechanism (hereinafter, referred to as a "drive mechanism"), which drives the pressure roller 62, will be described.

First, as shown in FIG. 2, the fixing unit 60 according to this exemplary embodiment includes a drive motor 90, a driving transmission gear 92, and a driving transmission gear 93, as a drive mechanism. The drive motor 90 serves as a drive source. The driving transmission gear 92 is fixed to a rotating shaft 91 of the drive motor 90. The driving transmission gear 93 is fixed to the rotating shaft 94 of the pressure roller 62. Further, the fixing unit 60 includes a swing support member 97 and a transmission gear 95. The swing support member 97 is swingably supported by the rotating shaft 94 of the pressure roller 62. The transmission gear 95 is fixed to a rotating shaft 96 rotatably supported by the swing support member 97, and is connected to the driving transmission gear 93 fixed to the pressure roller 62. Even though the contact/separation operation of the pressure roller 62 is performed by the retraction mechanism, the connection between the transmission gear 95 and the driving transmission gear 93 fixed to the pressure roller 62 is maintained by the swing support member 97. Further, the swing support member 97 is pushed against the driving transmission gear 92 by a pushing member (not shown) so that the transmission gear 95 is pressed against the driving transmission gear 92 fixed to the drive motor 90.

Subsequently, the transmission of a driving force from the drive motor 90 of the drive mechanism for the fixing unit 60 will be described. As described above, the pressure roller 62 comes into contact with and is separated from the fixing belt 61 by the retraction mechanism. Accordingly, the drive mechanism of the fixing unit 60 is adapted so that a driving force is transmitted to the pressure roller 62 from the drive motor 90 in both the state where the pressure roller 62 comes into press contact with the fixing belt 61 and the state where the pressure roller 62 is separated from the fixing belt 61.

Figure 8A:
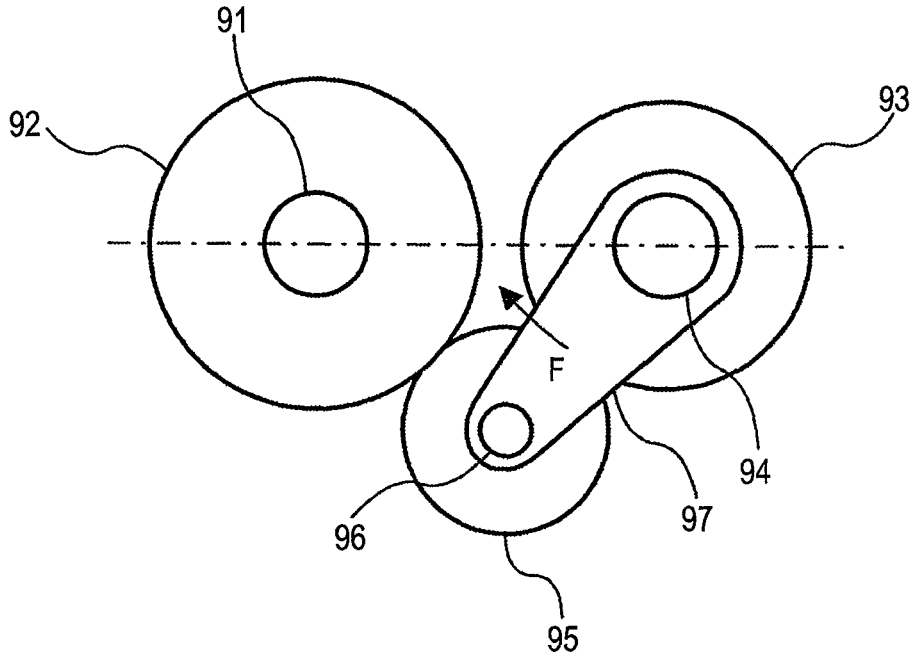
FIGS. 8A and 8B are views illustrating the transmission of a driving force to the pressure roller from a drive motor.
Figure 8B:
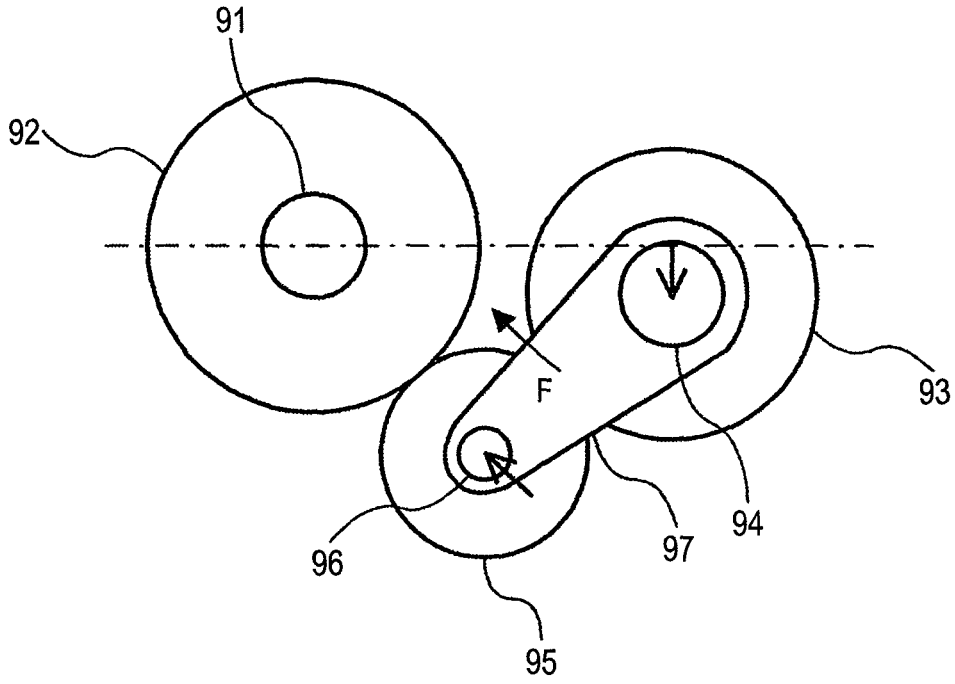

FIG. 8 is a view illustrating the transmission of a driving force to the pressure roller 62 from the drive motor 90. FIG. 8A shows a state where the pressure roller 62 comes into press contact with the fixing belt 61 due to the retraction mechanism, and FIG. 8B shows a state where the roller main body portion 62A of the pressure roller 62 is separated from the fixing belt 61.

As described above, the swing support member 97 applies a pushing force F toward the driving transmission gear 92 by a pushing member (not shown) so that the transmission gear 95 is pressed against the driving transmission gear 92 fixed to the drive motor 90. For this reason, while the pressure roller 62 comes into contact with the fixing belt 61, the transmission gear 95 supported by the swing support member 97 to which the pushing force F toward the driving transmission gear 92 is applied is connected with the driving transmission gear 92 fixed to the drive motor 90 as shown in FIG. 8A. Further, the transmission gear 95 is also connected with the driving transmission gear 93 fixed to the pressure roller 62. Accordingly, the rotational driving force from the drive motor 90 is transmitted to the pressure roller 62 by the connection between the transmission gear 95 and the driving transmission gear 92 fixed to the drive motor 90 and the connection between the transmission gear 95 and the driving transmission gear 93 fixed to the pressure roller 62, so that the pressure roller 62 is rotationally driven. Further, the pressure roller 62 rotates the fixing belt 61.

Furthermore, when the roller main body portion 62A of the pressure roller 62 is separated from the fixing belt 61, the driving transmission gear 93 and the rotating shaft 94 of the pressure roller 62 are moved in a direction where the driving transmission gear 93 and the rotating shaft 94 are separated from the fixing belt 61 (an arrow in FIG. 8B) as shown in FIG. 8B. In this case, the transmission gear 95 is moved in the direction toward the driving transmission gear 92 fixed to the drive motor 90 (an arrow in FIG. 8B) by the swing of the swing support member 97 to which the pushing force F toward the driving transmission gear 92 is applied, and the connection between the transmission gear 95 and the driving transmission gear 92 fixed to the drive motor 90 is maintained. Accordingly, even though the roller main body portion 62A of the pressure roller 62 is separated from the fixing belt 61, the rotational driving force from the drive motor 90 is transmitted to the pressure roller 62 by the connection between the transmission gear 95 and the driving transmission gear 92 fixed to the drive motor 90 and the connection between the transmission gear 95 and the driving transmission gear 93 fixed to the pressure roller 62, so that the pressure roller 62 is rotationally driven. Further, the power transmission members 62B and 62C of the pressure roller 62 rotate the fixing belt 61.

As described above, when the roller main body portion 62A of the pressure roller 62 is set not to come into press contact with the fixing belt 61 due to the retraction mechanism before the start of a fixing operation, the power transmission members 62B and 62C rotate the fixing belt 61 in the fixing unit 60 according to this exemplary embodiment. Meanwhile, when a fixing operation is started and the pressure roller 62 comes into press contact with the fixing belt 61 due to the retraction mechanism, the entire pressure roller 62 rotates the fixing belt 61.

<Description of IH Heater>

Next, the IH heater 63 that heats the conductive heating layer 612 by electromagnetic induction by making an AC magnetic field act on the conductive heating layer 612 of the fixing belt 61 will be described.

Figure 9:
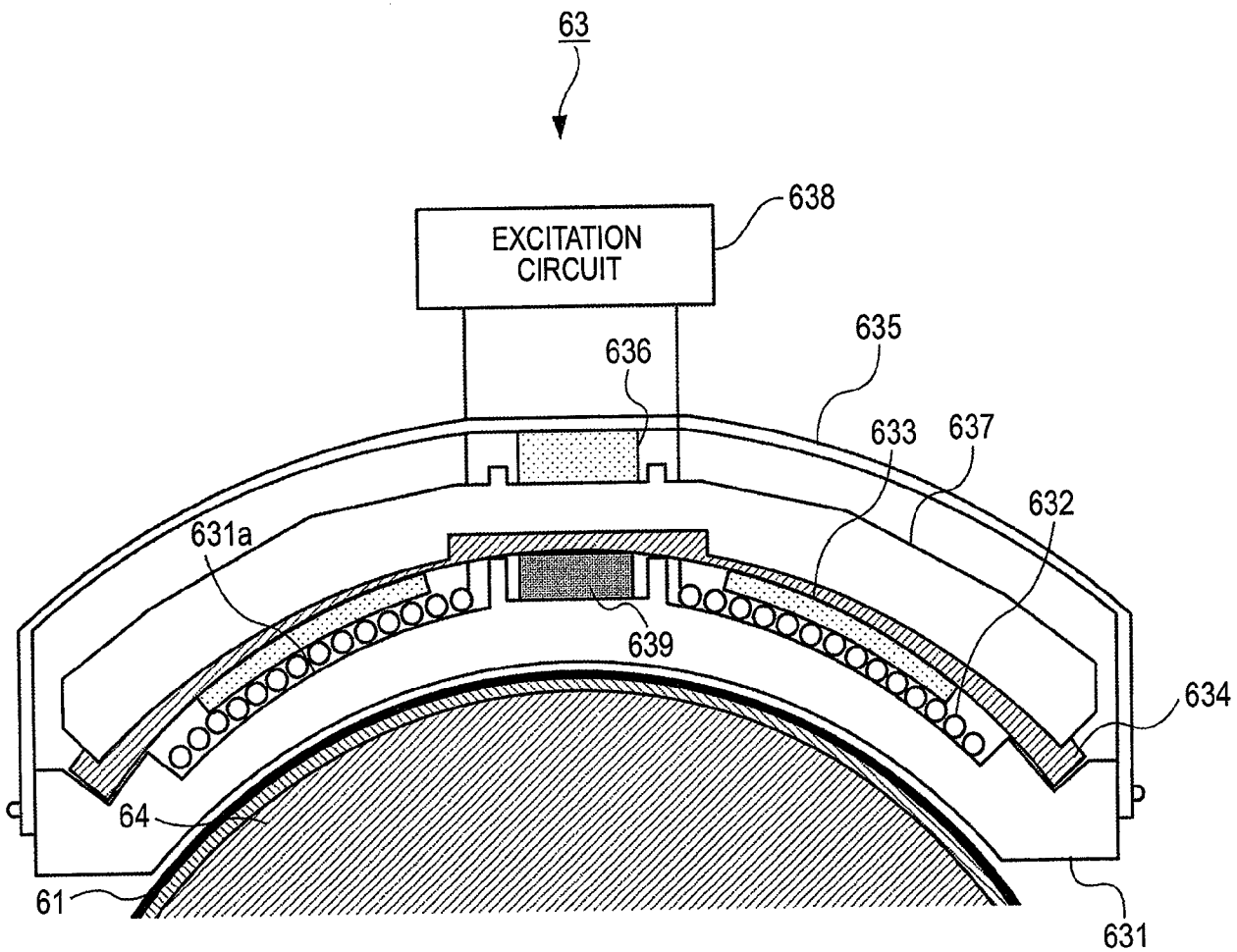
FIG. 9 is a cross-sectional view illustrating the structure of an IH heater of this exemplary embodiment.

FIG. 9 is a cross-sectional view illustrating the structure of the IH heater 63 of this exemplary embodiment. As shown in FIG. 9, the IH heater 63 includes a support 631, an exciting coil 632, an elastic support member 633, and plural magnetic cores 634. The support 631 is formed of a non-magnetic body such as, for example, a heat resistant resin. The exciting coil 632 generates an AC magnetic field. The elastic support member 633 fixes the exciting coil 632 to the support 631, and is formed of an elastic body such as, for example, silicone rubber. The plural magnetic cores 634 are disposed along the width direction of the fixing belt 61, and form magnetic paths of the AC magnetic field that is generated by the exciting coil 632. Further, the IH heater 63 includes plural adjustive magnetic cores 639, magnetic core holding members 637, a pressure member 636, a shield 635, and an excitation circuit 638. The plural adjustive magnetic cores 639 are disposed along the width direction of the fixing belt 61, and uniformize the AC magnetic field, which is generated by the exciting coil 632, in the longitudinal direction of the support 631. The magnetic core holding members 637 hold the magnetic cores 634 so as to cover the magnetic cores 634 from above. The pressure member 636 presses the magnetic cores 634 against the support 631 with the magnetic core holding members 637 interposed therebetween, and is formed of an elastic body such as, for example, silicone rubber. The shield 635 suppresses the leakage of a magnetic field to the outside by blocking a magnetic field. The excitation circuit 638 supplies alternating current to the exciting coil 632.

The support 631 is made of, for example, heat-resistant glass, heat-resistant resins, such as polycarbonate and PPS (polyphenylene sulfide), or heat-resistant non-magnetic materials such as heat-resistant resins that are formed by mixing glass fiber to them. Further, the support 631 is formed so that the cross-section of the support 631 is curved to follow the shape of surface of the fixing belt 61 and a supporting surface 631*a* supporting the exciting coil 632 is formed with a predetermined gap (for example, 0.5 to 2 mm) between the surface of the fixing belt 61 and the supporting surface.

The exciting coil 632 is formed by twisting litz wires in a hollow closed-loop shape, such as an oval or elliptical shape and a rectangular shape. Each of the litz wires is obtained by bundling, for example, 90 copper wire rods which are insulated from each other and each of which has a diameter of, for example, 0.17 mm. Further, when alternating current having a predetermined frequency is supplied to the exciting coil 632 from the excitation circuit 638, an AC magnetic field of which the center corresponds to the litz wires twisted in the closed-loop shape, is generated around the exciting coil 632. In general, the frequency of the alternating current, which is supplied to the exciting coil 632 from the excitation circuit 638, is in the range of 20 to 100 kHz that corresponds to the frequency of the AC magnetic field generated by the above-mentioned general-purpose power source.

The elastic support member 633 is a sheet-like member that is formed of an elastic body such as, for example, silicone rubber or fluoro rubber. The elastic support member 633 is set to press the exciting coil 632 against the support 631 so that the exciting coil 632 comes into close contact with and is fixed to the supporting surface 631*a* of the support 631.

A circular arc-shaped ferromagnet, which is made of, for example, fired ferrite, a ferrite resin, or an alloy material or an oxide having high magnetic permeability, such as Permalloy or a temperature-sensitive magnetic alloy, is used as the magnetic core 634. The magnetic cores 634 induce magnetic field lines (magnetic flux), which are caused by the AC magnetic field generated by the exciting coil 632, therein; and form paths (closed magnetic paths) of magnetic field lines that cross the fixing belt 61 from the magnetic cores 634 and return to the magnetic cores 634. Accordingly, the magnetic field lines of the AC magnetic field, which are generated by the exciting coil 632, are concentrated in an area that faces the magnetic cores 634 of the fixing belt 61.

Each of the magnetic core holding members 637 is formed of a non-magnetic body, such as SUS or a resin, and the magnetic core holding members 637 hold the magnetic cores 634 so as to cover a part or all of the magnetic cores 634, respectively.

A rectangular parallelepiped (block-like) ferromagnet, which is made of, for example, fired ferrite or a material having high magnetic permeability, such as a ferrite resin, is used as the adjustive magnetic cores 639. Further, the adjustive magnetic cores 639 reduce the temperature variation (temperature deviation or temperature ripple) in the width direction of the fixing belt 61 by uniformizing the intensity of the AC magnetic field, which is generated by the magnetic cores 634, in the longitudinal direction of the support 631 (=the width direction of the fixing belt 61).

As described above, the IH heater 63 generates magnetic field lines, which cross the fixing belt 61 in the thickness direction of the fixing belt 61, and generates an eddy current I, which is proportional to the variation of the number of the magnetic field lines (magnetic flux density) per unit area, in the conductive heating layer 612 of the fixing belt 61. Accordingly, the IH heater 63 heats the fixing belt 61 by generating Joule heat W ($W=I^2R$), which is the product of a specific resistance value R of the conductive heating layer 612 and the square of a value of the eddy current I, in the conductive heating layer 612.

<Description of Function of Elastic Member>

Next, the function of the elastic member 64, which is disposed inside the fixing belt 61, will be described.

As described above, the fixing unit 60 according to this exemplary embodiment includes the retraction mechanism that makes the pressure roller 62 come into contact with and be separated from the fixing belt 61. Further, an operation (warm-up operation), which heats the fixing belt 61 up to a fixing temperature by the IH heater 63, is performed before the start of a fixing operation, and the roller main body portion 62A of the pressure roller 62 is set to a position, which is separated from the fixing belt 61, by the retraction mechanism. Accordingly, a state where heat is hardly transferred to the pressure roller 62 from the fixing belt 61 having low heat capacity is set. As a result, the fixing belt 61 is efficiently heated, and the time (hereinafter, referred to as "warm-up time") required to heat the fixing belt 61 to a fixing temperature is reduced. Meanwhile, the power transmission members 62B and 62C of the pressure roller 62 rotate the fixing belt 61 during the warm-up operation.

Meanwhile, when the temperature of the fixing belt 61 approaches a fixing temperature due to the warm-up operation and reaches a predetermined temperature lower than the fixing temperature, the pressure roller 62 comes into press contact with the fixing belt 61 due to the retraction mechanism.

Accordingly, a nip portion N is formed between the fixing belt 61 and the pressure roller 62 by the elastic forces of both the roller main body portion 62A of the pressure roller 62 and the elastic member 64 that is disposed inside the fixing belt 61 over the entire width of the fixing belt 61. Further, when the nip portion N is formed and the fixing belt 61 reaches a fixing temperature, a sheet P is conveyed to the nip portion N and the fixing operation is started.

Figure 10A:
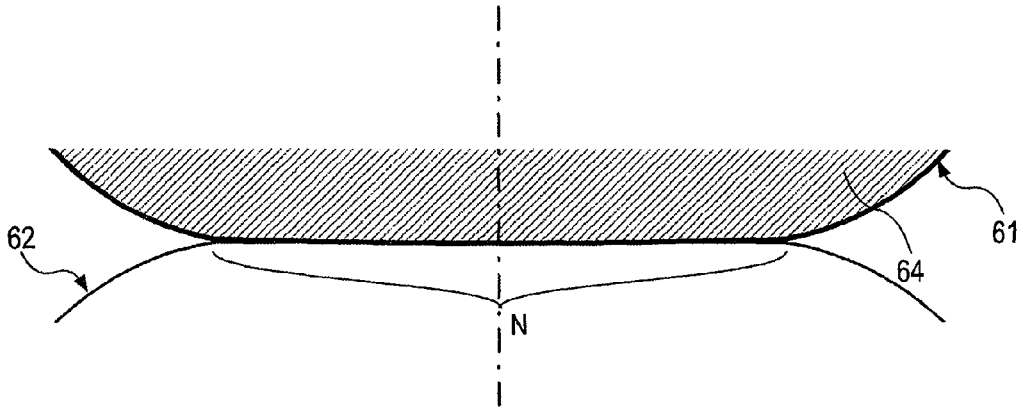
FIGS. 10A and 10B are views showing the state of the fixing belt at a nip portion.
Figure 10B:
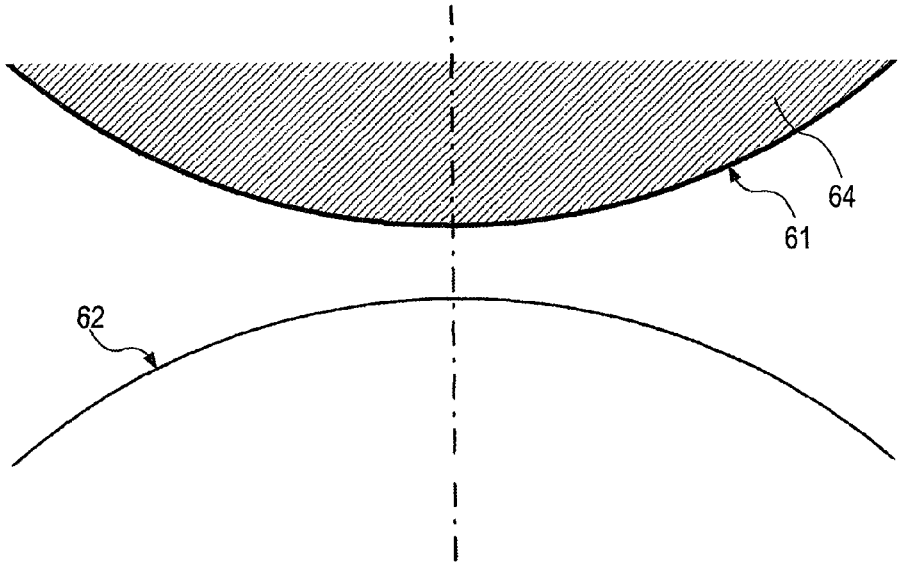

Next, FIG. 10 is a view showing the state of the fixing belt 61 at the nip portion N. FIG. 10A shows that the pressure roller 62 comes into press contact with the fixing belt 61, and FIG. 10B shows that the roller main body portion 62A of the pressure roller 62 is separated from the fixing belt 61.

During the fixing operation, the pressure roller 62 is disposed so as to come into press contact with the fixing belt 61 due to the retraction mechanism as shown in FIG. 10A. Accordingly, the nip portion N with predetermined nip pressure is formed by the pressure roller 62 that presses the elastic member 64 with the fixing belt 61 interposed therebetween while being elastically deformed, and the elastic member 64 that is elastically deformed by the pressing force applied from the pressure roller 62. When the pressure roller 62 is disposed so as to come into press contact with the fixing belt 61 as described above, the elastic member 64 receives a pressing force from the pressure roller 62 and is elastically deformed, so that a nip portion N is formed. Here, nip pressure is stably set to a predetermined pressure by both the pressure roller 62 and the elastic member 64 that are elastically deformed.

Meanwhile, during the warm-up operation, the roller main body portion 62A of the pressure roller 62 is disposed so as to be separated from the fixing belt 61 by the retraction mechanism as shown in FIG. 10B. In this case, the shapes of the fixing belt 61 and the elastic member 64 are restored over the entire circumference of the fixing belt 61.

As described above, the roller main body portion 62A of the pressure roller 62 is separated from the fixing belt 61 by the retraction mechanism during the warm-up operation. Accordingly, a state where heat is hardly transferred to the pressure roller 62 from the fixing belt 61 is set. As a result, a structure that reduces warm-up time required to heat the fixing belt 61 to a fixing temperature is obtained. Further, in this case, the fixing belt 61 is adapted to be rotated by the power transmission members 62B and 62C of the pressure roller 62.

As described above, the fixing unit 60 according to this exemplary embodiment is provided with a drive mechanism that transmits a driving force to the pressure roller 62 in both the state where the pressure roller 62 comes into press contact with the fixing belt 61 due to the retraction mechanism and the state where the roller main body portion 62A of the pressure roller 62 is separated from the fixing belt 61 by the retraction mechanism, and rotates the fixing belt 61. Accordingly, a structure that rotationally drives the fixing belt 61 is simplified, so that the cost and size of the fixing unit 60 are reduced.

<Description of Control of Operation for Image Forming Processing>

Subsequently, the flow of an image forming operation will be described.

Figure 11:
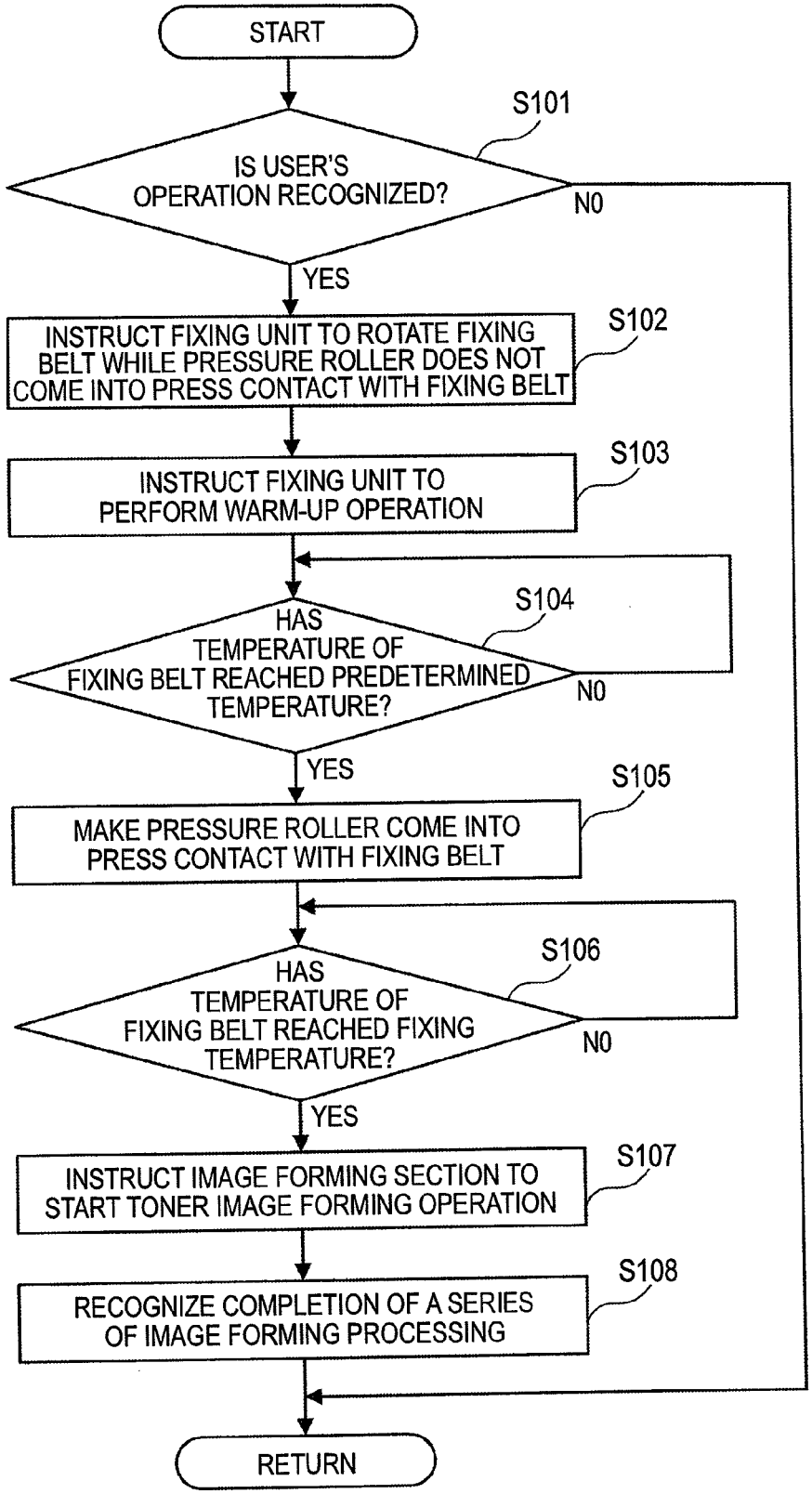
FIG. 11 is a flowchart illustrating an example of contents of image forming processing that is performed by a main control section.

FIG. 11 is a flowchart illustrating an example of contents of image forming processing that is performed by the main control section 31. As shown in FIG. 11, the main control section 31 monitors an operation (hereinafter, referred to as a "user' s operation"), which is performed before a user' s image forming instruction, such as an instruction or the like placing a document on the image reading section 33, on the basis of signals or the like from the image reading section 33, the UI section 35, or the communication section 32 (Step 101). Further, if the main control section 31 recognizes a user' s operation (Yes in Step 101), the main control section 31 instructs the fixing unit 60 to drive the drive motor 90 (see FIG. 2) and to rotate the fixing belt 61 while the roller main body portion 62A of the pressure roller 62 does not come into press contact with the fixing belt 61 due to the retraction mechanism (Step 102). After that, the main control section 31 instructs the fixing unit to perform a warm-up operation (Step 103).

Since the roller main body portion 62A of the pressure roller 62 is separated from the fixing belt 61 in this step, heat is hardly transferred to the pressure roller 62 from the fixing belt 61. Accordingly, the transfer of heat from the fixing belt 61 having low heat capacity is suppressed, so that a warm-up time required to heat the fixing belt 61 to a fixing temperature is reduced. Meanwhile, if the main control section does not recognize a user's operation (No in Step 101), the main control section 31 continues to monitor a user's operation (Step 101).

Further, if the temperature of the fixing belt 61 reaches a predetermined temperature that is close to a fixing temperature and lower than the fixing temperature by the warm-up operation (Yes in Step 104), the main control section 31 makes the pressure roller 62 come into press contact with the fixing belt 61 due to the retraction mechanism (Step 105). Further, if the temperature of the fixing belt 61 coming into press contact with the pressure roller 62 reaches the fixing temperature (Yes in Step 106), the main control section 31 instructs the image forming section 10 to start a toner image forming operation (Step 107). Since the pressure roller 62 is disposed so as to come into press contact with the fixing belt 61 in this step, a nip portion N with predetermined nip pressure is formed between the fixing belt 61 and the pressure roller 62 by the elastic forces of both the elastic member 64 and the pressure roller 62. Further, if the main control section 31 recognizes the completion of a series of image forming processing (Step 108), the main control section returns to Step 101 and monitors a user's operation.

Figure 12:
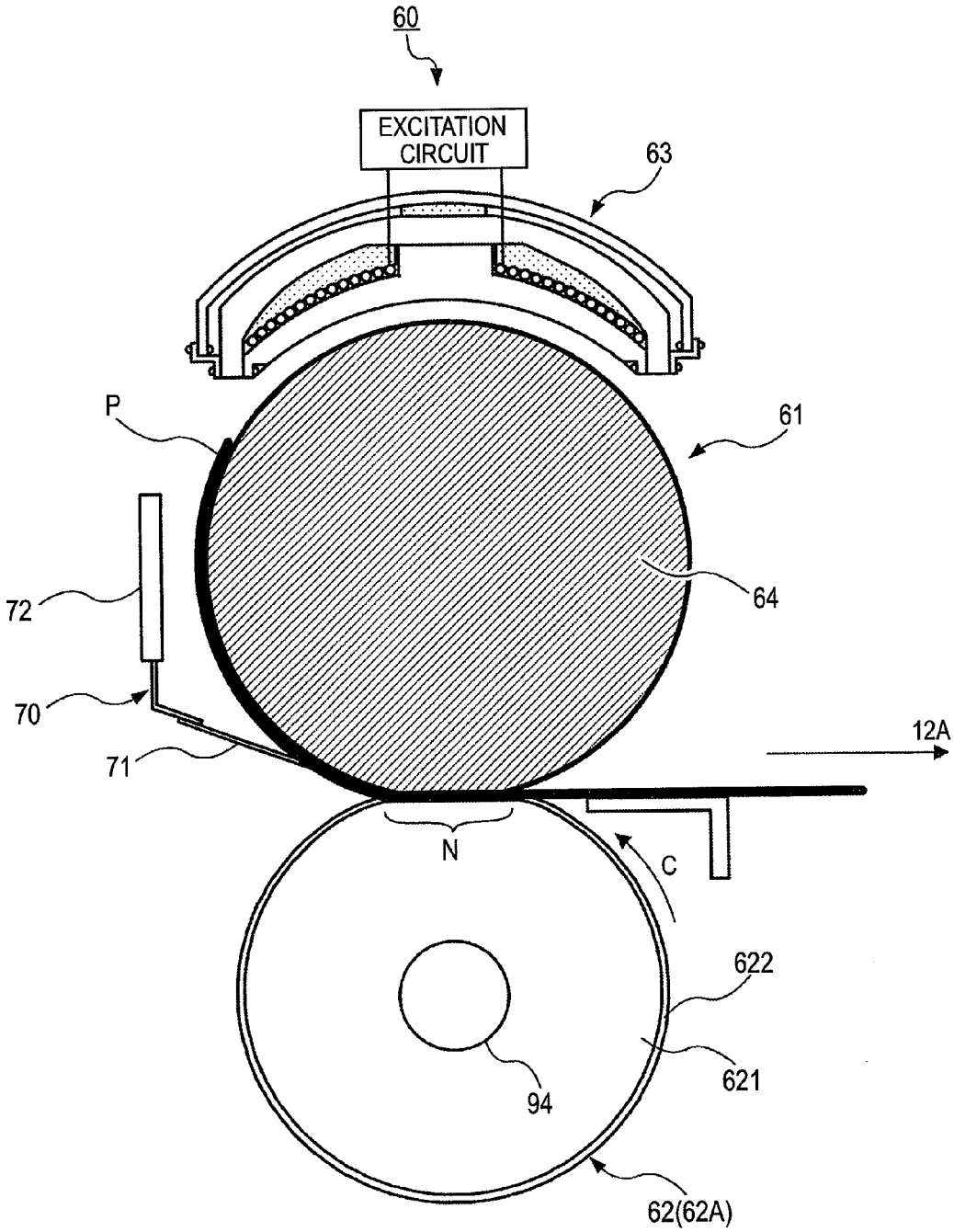
FIG. 12 is a view showing the state of the fixing unit when poor conveyance of a sheet occurs.

Meanwhile, if a thin sheet P or the like is conveyed to the fixing unit 60 according to this exemplary embodiment, the sheet P may not be separated from the fixing belt 61 as shown in FIG. 12 (a view showing the state of the fixing unit 60 when poor conveyance of a sheet occurs). In other words, the sheet S is wound on the fixing belt 61. In this case, poor conveyance of the sheet P is detected by a sensor (not shown) and the drive of the fixing unit 60 and the like is stopped in this exemplary embodiment. Further, the pressure roller 62 retracts, so that the roller main body portion 62A is separated from the fixing belt 61 (the contact between the power transmission members 62B and 62C and the fixing belt 61 is maintained). Furthermore, the fact that poor conveyance of a sheet P has occurred is notified to a user through the user interface (UI) section 35. Moreover, a sheet P, which causes poor conveyance, is removed by a user. Here, a user can remove the sheet P, which causes poor conveyance, by pulling the sheet P toward the upstream side in the conveying direction of a sheet P as shown by an arrow 12A of FIG. 12.

Figure 13:
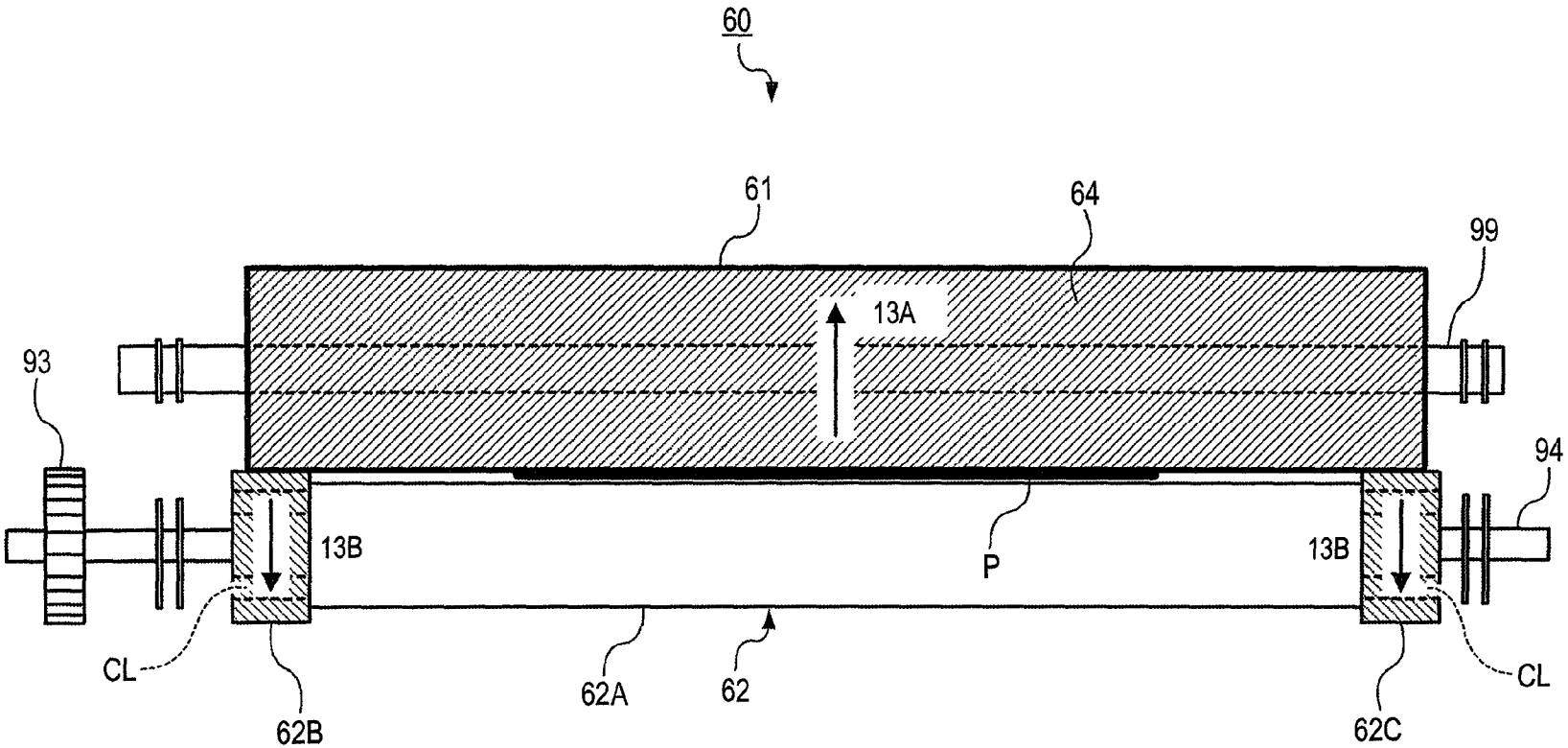
FIG. 13 is a view showing the fixing unit at the time of pulling a sheet when seen from the upstream side in a conveying direction of a sheet.

Meanwhile, when the sheet P is pulled toward the upstream side in the conveying direction of a sheet P, an external force is applied to the fixing belt 61 and the fixing belt 61 is moved in a direction opposite to the moving direction of the fixing belt corresponding to the time of fixing as shown by an arrow 13A of FIG. 13 (a view showing the fixing unit 60 at the time of pulling the sheet P when seen from the upstream side in the conveying direction of a sheet P). Further, as the fixing belt 61 is moved as described above, a rotational driving force is transmitted to the power transmission members 62B and 62C from the fixing belt 61. Accordingly, the power transmission members 62B and 62C also rotate in a direction opposite to the rotational direction of the power transmission members corresponding to the time of fixing (see an arrow 13B). Here, as described above, the one-way clutches CL are provided between the pressure roller 62 and the power transmission members 62B and 62C in the fixing unit 60 according to this exemplary embodiment. For this reason, when the power transmission members 62B and 62C rotate in the opposite direction as described above, the power transmission members 62B and 62C idle with respect to the pressure roller 62. In other words, a rotational driving force is not transmitted to the pressure roller 62 from the power transmission members 62B and 62C. Meanwhile, when the power transmission members 62B and 62C are rotated by an external force in a rotational direction corresponding to the time of fixing, the pressure roller 62 rotates while interlocking with the power transmission members 62B and 62C since the one-way clutches CL are provided.

Here, the fixing unit 60 according to this exemplary embodiment has been provided with one-way clutches CL as described above. However, the fixing unit 60 may be formed without the one-way clutches CL. More specifically, the power transmission members 62B and 62C may be directly mounted on the pressure roller 62. In this case, there is a concern that portions of the fixing belt 61 coming into contact with the power transmission members 62B and 62C or the outer peripheral surfaces of the power transmission members 62B and 62C will be scratched. Further, there is also a concern that the fixing belt 61 will be distorted.

In detail, since the pressure roller 62 of this exemplary embodiment is connected to the drive motor 90 (see FIG. 2), the pressure roller 62 does not easily rotate (does not easily idle). For this reason, if a rotational driving force is transmitted to the power transmission members 62B and 62C from the fixing belt 61 when the one-way clutches CL are omitted and the power transmission members 62B and 62C are directly mounted on the pressure roller 62, the pressure roller 62 does not rotate and slippage may occur between the fixing belt 61 and the power transmission members 62B and 62C. In other words, if a sheet P is pulled and the fixing belt 61 is moved when the power transmission members 62B and 62C are directly mounted on the pressure roller 62, the pressure roller 62 does not easily rotate. For this reason, the fixing belt 61 slips on the power transmission members 62B and 62C.

When the slippage occurs, there is a concern that the outer peripheral surfaces of the power transmission members 62B and 62C or portions of the fixing belt 61 coming into contact with the power transmission members 62B and 62C are scratched. Further, a pulling force is applied from a sheet P to a middle portion of the fixing belt 61 in the width direction of the fixing belt 61, so that the middle portion of the fixing belt 61 in the width direction of the fixing belt 61 is to be moved. However, the movement of the portions of the fixing belt 61, which come into contact with the power transmission members 62B and 62C, is restricted. In this case, distortion is apt to occur on the fixing belt 61. For this reason, the one-way clutches CL are provided in this exemplary embodiment as described above in order to suppress the occurrence of this trouble. When the one-way clutches CL are provided, the power transmission members 62B and 62C idle with respect to the pressure roller 62 as described above. In this case, the occurrence of slippage between the fixing belt 61 and the power transmission members 62B and 62C is suppressed. Further, the fixing belt 61 is also hardly distorted.

Meanwhile, when a warm-up operation is performed in the structure of this exemplary embodiment, the pressure roller is rotated in a direction opposite to the rotational direction of the pressure roller corresponding to the time of fixing. More specifically, the pressure roller 62 is rotated in the direction of an arrow 14A shown in FIG. 14A (a view showing the fixing unit 60 at the time of a warm-up operation when seen from the upstream side in the conveying direction of a sheet P). Meanwhile, when the pressure roller 62 is rotated in the same direction as the rotational direction of the pressure roller corresponding to the time of fixing, a rotational driving force is not transmitted to the power transmission members 62B and 62C from the pressure roller 62 since the one-way clutches CL are provided. Accordingly, the fixing belt 61 is not rotated. For this reason, when a warm-up operation is performed in this exemplary embodiment, the pressure roller 62 is rotated in a direction opposite to the rotational direction of the pressure roller corresponding to the time of fixing. Accordingly, a rotational driving force is transmitted to the power transmission members 62B and 62C from the pressure roller 62, so that the power transmission members 62B and 62C follow the pressure roller 62. Therefore, the power transmission members 62B and 62C rotate while interlocking with the pressure roller 62 (see an arrow 14B). Further, as the power transmission members 62B and 62C rotate, a rotational driving force is transmitted to the fixing belt 61, so that the fixing belt 61 also rotates (see an arrow 14C).

Figure 14A:
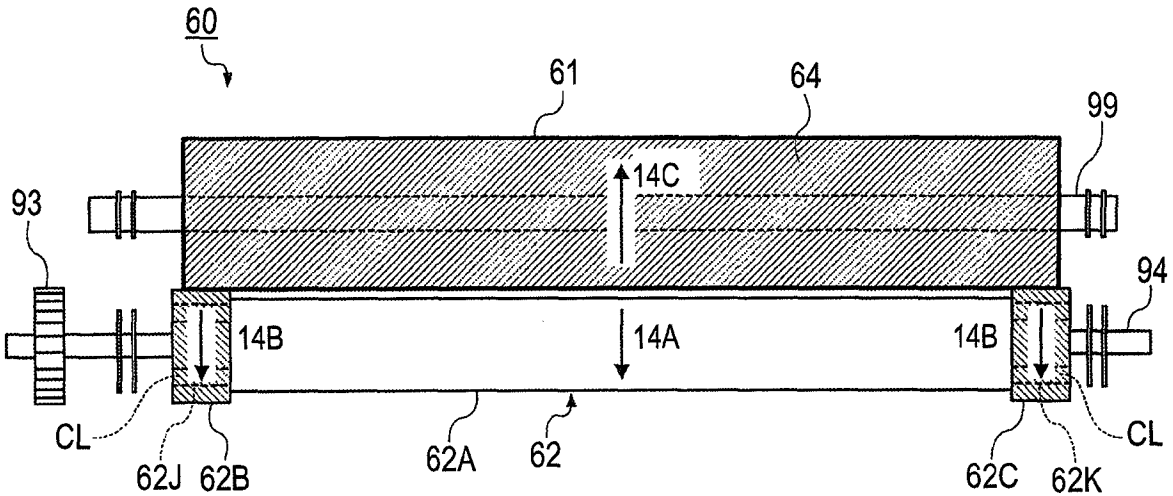
FIGS. 14A and 14B are views showing the fixing unit at the time of a warm-up operation or the like when seen from the upstream side in the conveying direction of a sheet.
Figure 14B:
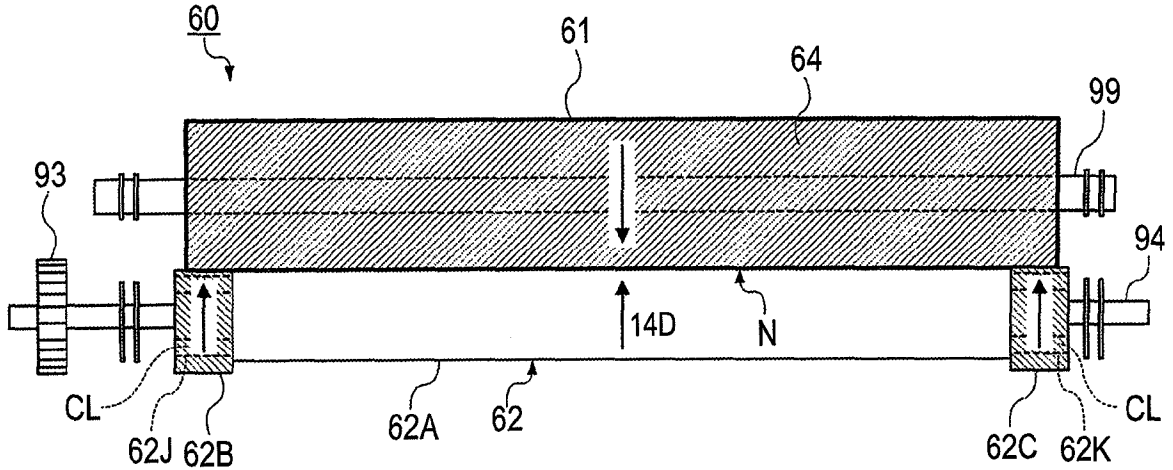

Moreover, when a warm-up operation is ended and a fixing operation is performed, the drive motor 90 is driven in a reverse direction and the pressure roller 62 rotates in the direction of an arrow 14D shown in FIG. 14B. In this case, the power transmission members 62B and 62C receive a rotational driving force from not the pressure roller 62 but the fixing belt 61, and rotate while following the fixing belt 61. More specifically, when the pressure roller 62 rotates, the transmission of a rotational driving force is cut off since there are provided one-way clutches CL functioning as cut-off units or cut-off mechanisms. For this reason, a rotational driving force is not transmitted to the power transmission members 62B and 62C from the pressure roller 62. Meanwhile, a rotational driving force is transmitted to the fixing belt 61 from the pressure roller 62. For this reason, the power transmission members 62B and 62C receive a rotational driving force from not the pressure roller 62 but the fixing belt 61, and rotate while following the fixing belt 61.

Figures 15A, 15B, 15C:
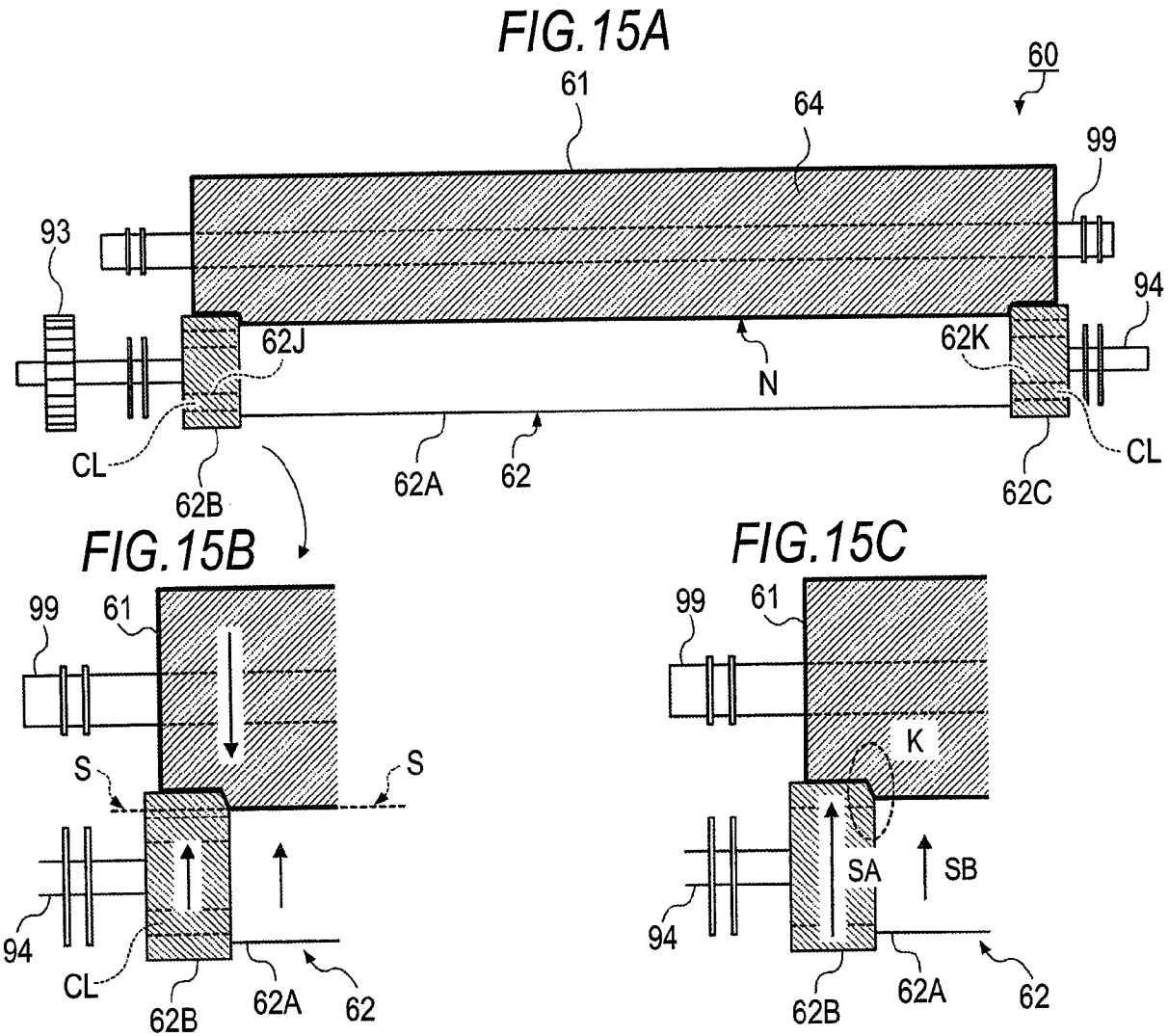
FIGS. 15A to 15C are views showing another example of the fixing unit when seen from the upstream side in the conveying direction of a sheet.

A structure where the power transmission members 62B and 62C are compressed up to a position corresponding to a surface position S of the roller main body portion 62A when a fixing operation is performed has been exemplified above. Meanwhile, the invention is not limited to this exemplary embodiment, and a fixing operation may be performed while the power transmission members 62B and 62C protrude from a surface position S as shown in FIGS. 15A and 15B (views showing another example of the fixing unit 60 when seen from the upstream side in the conveying direction of a sheet P). FIG. 15B is an enlarged view of a part of FIG. 15A.

Meanwhile, if the power transmission members 62B and 62C protrude from the surface position S and the above-mentioned one-way clutches CL are not provided, distortion is apt to occur on the fixing belt 61 as described above. More specifically, referring to FIG. 15C, if the power transmission members 62B and 62C protrude from the surface position S, the peripheral speed SA of the power transmission members 62B and 62C (the moving speed of the outer peripheral surface of the power transmission members 62B and 62C) is higher than the peripheral speed SB of the roller main body portion 62A (the moving speed of the outer peripheral surface of the roller main body portion 62A) when the pressure roller 62 is rotationally driven. In this case, the moving distances of a portion of the fixing belt 61, which comes into contact with each of the power transmission members 62B and 62C, per unit time are longer than that of a portion of the fixing belt 61, which comes into contact with the roller main body portion 62A, per unit time.

Further, if a difference occurs between the moving distances as described above, distortion is apt to occur on the fixing belt 61. More specifically, distortion (deformation) is apt to occur on the fixing belt 61 at a boundary (see reference letter K) between the portion of the fixing belt 61 coming into contact with each of the power transmission members 62B and 62C and the portion of the fixing belt 61 coming into contact with the roller main body portion 62A. Further, if the distortion repeatedly occurs as the fixing belt 61 rotates, there is a concern that cracks and the like will be formed at the fixing belt 61. For this reason, the one-way clutches CL are provided in this exemplary embodiment to suppress the distortion of the fixing belt 61.

In the case of the structure of this exemplary embodiment where the one-way clutches CL are provided (see FIG. 15B), as described above, the power transmission members 62B and 62C receive a rotational driving force from not the pressure roller 62 but the fixing belt 61 and rotate while following the fixing belt 61. In this case, a difference between the moving distance of a portion of the fixing belt 61, which comes into contact with each of the power transmission members 62B and 62C, per unit time and the moving distance of a portion of the fixing belt 61, which comes into contact with the roller main body portion 62A, per unit time is smaller than a difference between the moving distances thereof that is generated in the case where the one-way clutches CL are not provided (a case shown in FIG. 15C). Further, if the difference between the moving distances becomes small as described above, distortion hardly occurs on the fixing belt 61.

Meanwhile, when a warm-up operation is performed in the structure of this exemplary embodiment, the pressure roller 62 is rotated in the direction of the arrow 14A (in the direction opposite to the rotational direction of the pressure roller corresponding to the time of fixing) as described with reference to FIG. 14A. Accordingly, the power transmission members 62B and 62C rotate, and a rotational driving force is transmitted to the fixing belt 61 from the power transmission members 62B and 62C.

Meanwhile, a case in which the one-way clutches CL are provided has been exemplified above, but the one-way clutches CL may be substituted with electromagnetic clutches.

Figure 16A:
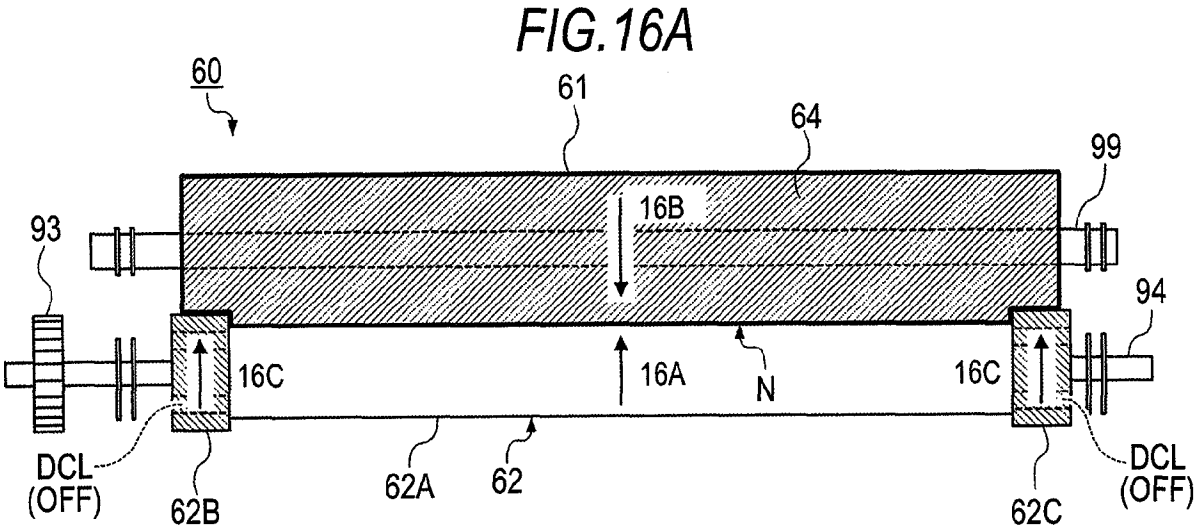
FIGS. 16A and 16B are views showing a fixing unit where electromagnetic clutches are provided between a pressure roller and power transmission members.
Figure 16B:
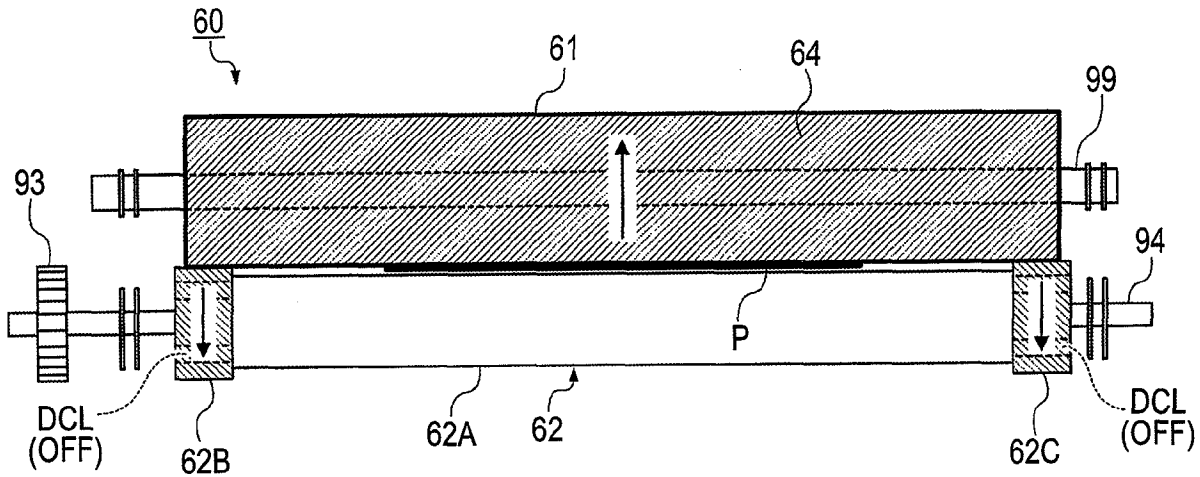
Figure 17:
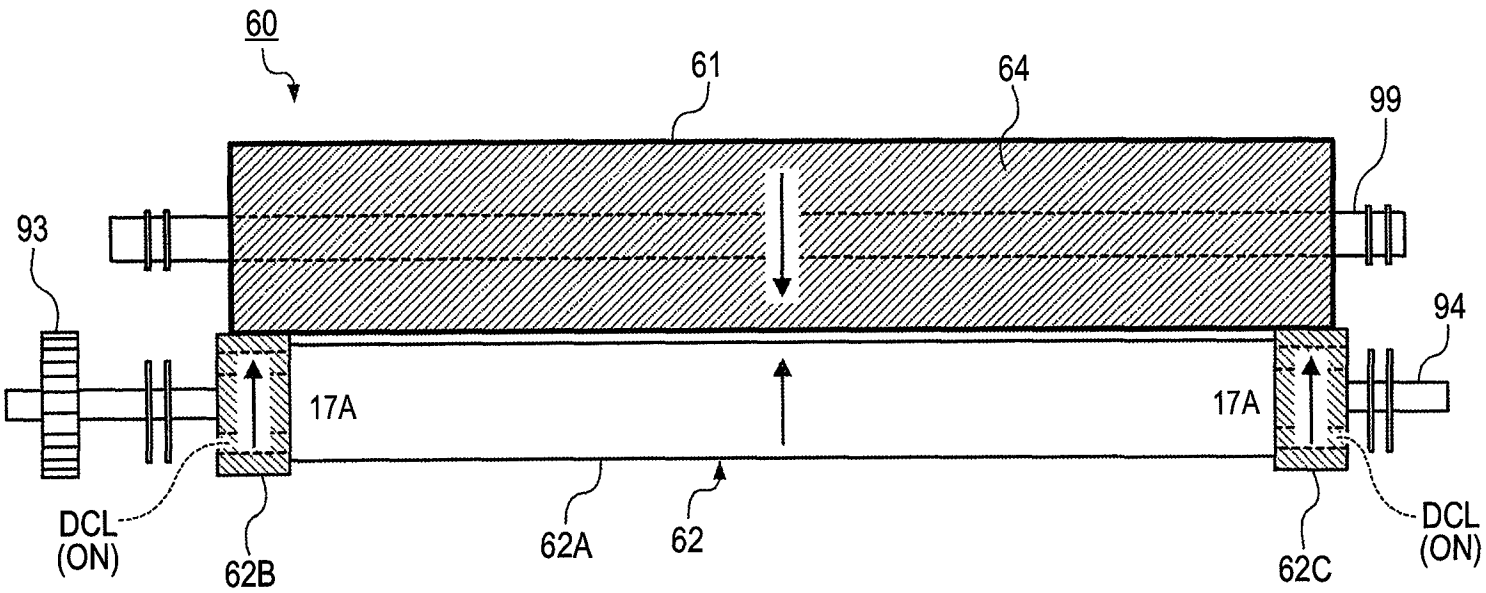
FIG. 17 is a view showing the fixing unit where the electromagnetic clutches are provided between the pressure roller and the power transmission members.

FIGS. 16 and 17 are views showing a fixing unit 60 where electromagnetic clutches DCL are provided between a pressure roller 62 and power transmission members 62B and 62C. Meanwhile, the structure other than the electromagnetic clutches DCL is the same as the above-mentioned structure.

Likewise, FIGS. 16 and 17 show the fixing unit when seen from the upstream side in the conveying direction of a sheet P.

Here, when a fixing operation is performed in the fixing unit 60 according to this exemplary embodiment, the electromagnetic clutches DCL (another example of the cut-off units) are turned off as shown in FIG. 16A. Accordingly, the connection between the pressure roller 62 and the power transmission members 62B and 62C is released, and a rotational driving force is not transmitted to the power transmission members 62B and 62C from the pressure roller 62. Further, in this exemplary embodiment, the pressure roller 62 is rotated in the direction of an arrow 16A and the fixing belt 61 rotates in the direction of an arrow 16B while following the pressure roller 62. Furthermore, the power transmission members 62B and 62C rotate while following the fixing belt 61 (see an arrow 16C). Here, a difference between the moving distance of a portion of the fixing belt 61, which comes into contact with each of the power transmission members 62B and 62C, per unit time and the moving distance of a portion of the fixing belt 61, which comes into contact with the roller main body portion 62A, per unit time becomes small even in the structure of this exemplary embodiment. Accordingly, distortion hardly occurs on the fixing belt 61.

Moreover, in this exemplary embodiment, the electromagnetic clutches DCL are set to be turned off by an instruction sent from the main control section 31 even when a sheet P is wound on the fixing belt 61 and poor conveyance of the sheet P is detected by a sensor (not shown). Accordingly, the connection between the pressure roller 62 and the power transmission members 62B and 62C is released. Further, when the sheet P is pulled toward the upstream side in the conveying direction of a sheet P as shown in FIG. 16B, the power transmission members 62B and 62C idle with respect to the pressure roller 62 as described above.

Furthermore, when a warm-up operation is performed in the structure of this exemplary embodiment, the electromagnetic clutches DCL are turned on and the power transmission members 62B and 62C rotate as shown by an arrow 17A of FIG. 17 while following the pressure roller 62. Moreover, as the power transmission members 62B and 62C rotate, the fixing belt 61 rotates. Meanwhile, when a warm-up operation is performed in this structure, the pressure roller 62 rotates in the same direction as the rotational direction of the pressure roller corresponding to the time of fixing.

<Description of Another Example of Power Transmission Member Provided on Pressure Roller>

Here, another structure of the power transmission members 62B and 62C, which are provided on the pressure roller 62, other than the above-mentioned structure will be described. For example, the structure where the power transmission members 62B and 62C are supported by the roller main body portion 62A with the one-way clutches CL interposed therebetween has been described in FIG. 5. Here, a structure where power transmission members 62B and 62C are not supported by a roller main body portion 62A will be described.

Figure 18A:
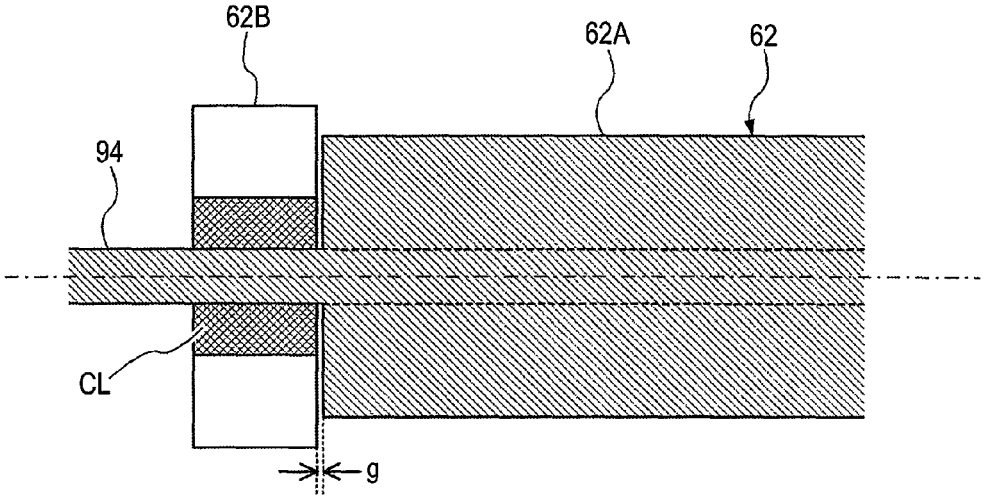
FIGS. 18A and 18B are views showing another example of the pressure roller.
Figure 18B:
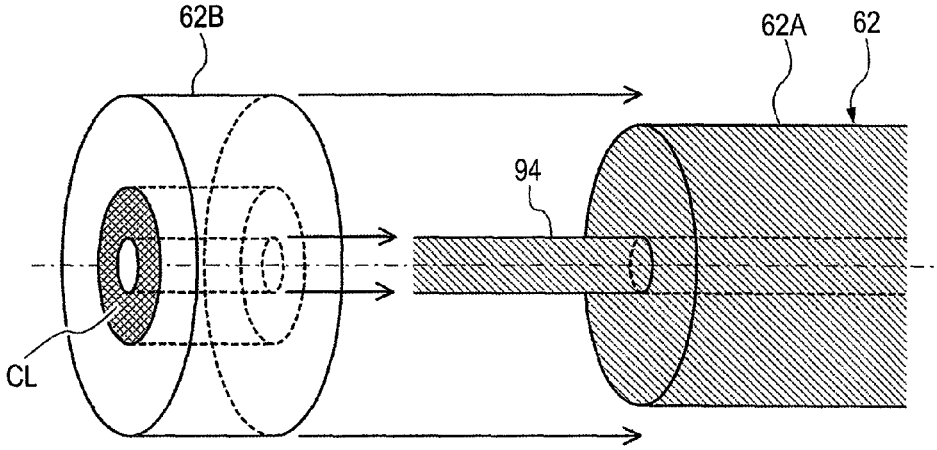

FIG. 18 is a view showing another example of the pressure roller 62. Meanwhile, FIG. 18A is a view showing the cross-sectional structure of the pressure roller 62, and FIG. 18B is a perspective view illustrating a process that assembles the pressure roller 62. Meanwhile, the power transmission member 62B, which is provided at one end portion of the pressure roller, is shown in FIG. 18, but the power transmission member 62C, which is provided at the other end portion of the pressure roller, also has the same structure as the structure of the power transmission member 62B. Further, a case where one-way clutches CL are used will be exemplified below, but the above-mentioned electromagnetic clutches DCL may be used.

As shown in FIGS. 18A and 18B, the power transmission members 62B and 62C are formed separately from the roller main body portion 62A and each of the power transmission members 62B and 62C is fitted around and mounted on the rotating shaft 94 with the one-way clutch CL interposed therebetween. Further, as shown in FIG. 18A, each of the power transmission members 62B and 62C is disposed with a gap g between the roller main body portion 62A and itself.

Accordingly, when the pressure roller 62 is disposed so as to come into press contact with the fixing belt 61, the elastically deformed power transmission members 62B and 62C come into press contact with the roller main body portion 62A of the pressure roller 62 that forms a nip portion N while being elastically deformed. For this reason, the lack of uniformity of nip pressure is suppressed at both end portions of the roller main body portion 62A. That is, since the power transmission members 62B and 62C are formed separately from the roller main body portion 62A, the elastic deformation of the power transmission members 62B and 62C hardly affects the roller main body portion 62A. Further, since each of the elastically deformed power transmission members 62B and 62C does not come into contact with the elastically deformed roller main body portion 62A due to the gap g between the roller main body portion 62A and each of the power transmission members 62B and 62C, the elastic deformation of the power transmission members 62B and 62C affects the roller main body portion 62A even less. In this way, the uniformity of nip pressure is secured at both end portions of the roller main body portion 62A by the structure of the power transmission members 62B and 62C shown in FIG. 18.

As described above, the fixing unit 60 according to the above-mentioned exemplary embodiment sets a state where heat is hardly transferred to the pressure roller 62 from the fixing belt 61, by separating the roller main body portion 62A of the pressure roller 62 from the fixing belt 61 during the operation (warm-up operation) that heats the fixing belt 61 up to a fixing temperature. In addition, the fixing unit 60 according to the above-mentioned exemplary embodiment is provided with a drive mechanism that transmits a driving force to the pressure roller 62 in both the state where the pressure roller 62 comes into press contact with the fixing belt 61 and the state where the roller main body portion 62A of the pressure roller 62 is separated from the fixing belt 61, and rotates the fixing belt 61. Accordingly, the time (warm-up time) required to heat the fixing belt 61 to a fixing temperature is reduced. Further, the structure that rotationally drives the fixing belt 61 is simplified, so that the cost and size of the fixing unit 60 are reduced.

Meanwhile, a case where the fixing belt 61 is heated by the IH heater 63 has been exemplified above, but a roller-like member in which a heater is built may come into contact with the fixing belt 61 so as to heat the fixing belt 61. Further, in the above-mentioned exemplary embodiment, the belt-like member (fixing belt 61) has been used as a fixing member that fixes a toner image formed on a sheet P. However, the fixing member is not limited to the belt-like member and, for example, a roller-like member may be used as the fixing member. Furthermore, the elastic member 64, which is disposed to completely fill the inside of the fixing belt 61, has received pressure from the pressure roller 62 in the above-mentioned exemplary embodiment. However, a pad member may be used to receive pressure from the pressure roller 62.

Figure 19:
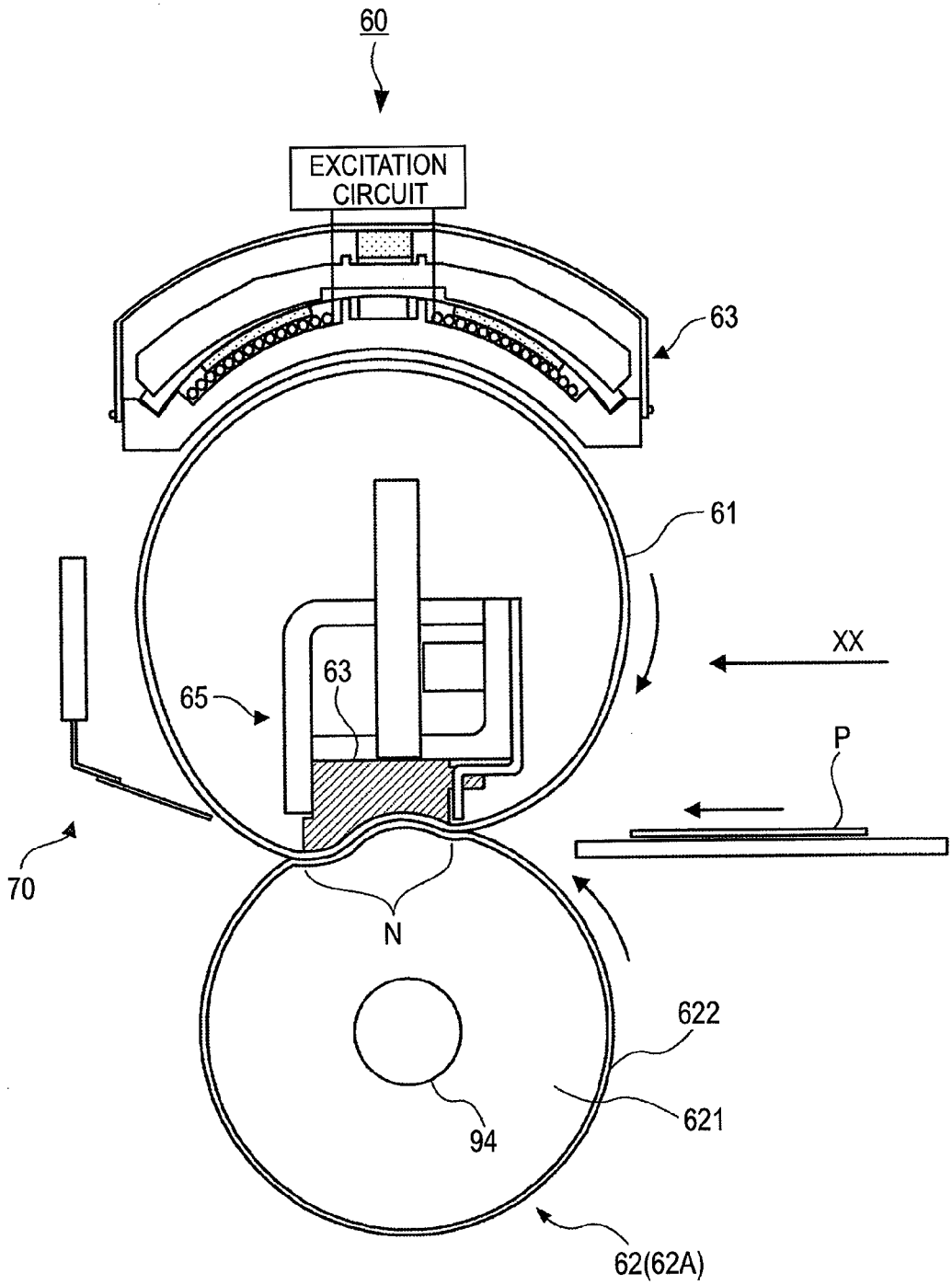
FIG. 19 is a view showing a fixing unit that is provided with a pad member.
Figure 20:
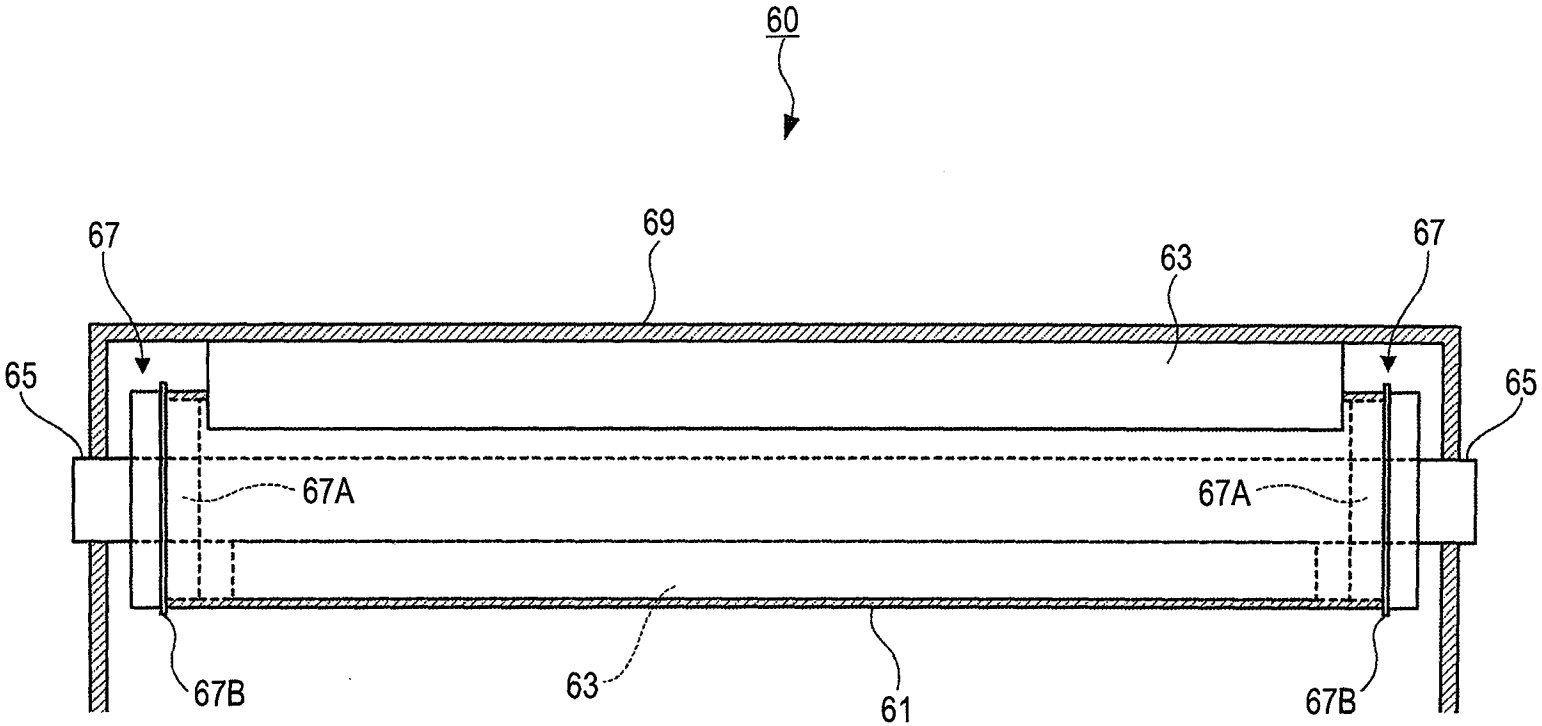
FIG. 20 is a view showing the fixing unit that is provided with the pad member.

FIGS. 19 and 20 are views showing a fixing unit 60 that is provided with a pad member. Meanwhile, FIG. 20 is a view showing the fixing belt 61 when seen from the direction of an arrow XX of FIG. 19. Further, the same functions as the above-mentioned functions are denoted by the same reference numerals, and the description thereof will be omitted here.

In the fixing unit 60 according to this exemplary embodiment, a pressing pad 63, which is pressed by the pressure roller 62 with the fixing belt 61 interposed therebetween, is provided inside the fixing belt 61. Further, in this exemplary embodiment, a nip portion N is formed at a position where the pressing pad 63 and the pressure roller 62 come into press contact with each other. Furthermore, in the fixing unit 60 according to this exemplary embodiment, a holder 65, which supports a component such as the pressing pad 63, is provided on the more inner side of the fixing belt 61 as compared to the pressing pad 63.

Moreover, in the fixing unit 60 according to this exemplary embodiment, end cap members 67, which maintain the circular cross-sectional shape of both end portions of the fixing belt 61, are mounted on both end portions of the fixing belt 61 as shown in FIG. 20. Here, each of the end cap members 67 is formed in the shape of a disc. Further, each of the end cap members 67 includes a fixing portion 67A that is fitted to the inside of the fixing belt 61. Furthermore, each of the end cap members 67 includes a flange portion 67B that is formed to have an outer diameter larger than the outer diameter of the fixing portion 67A and protrudes outward from the outer peripheral surface of the fixing belt 61 when each of the end cap members 67 is mounted on the fixing belt 61.

Moreover, each of the end cap members 67 includes a bearing portion (not shown) at the central portion thereof in a radial direction. Each of the end cap members 67 is mounted on the holder 65 through the bearing portion. Accordingly, each of the end cap members 67 is adapted to rotate about the holder 65. In other words, the fixing belt 61 is also adapted to rotate about the holder 65. Meanwhile, both end portions of the holder 65 are supported by the support 69 as shown in FIG. 20.

Here, even in the fixing unit 60 according to this exemplary embodiment, the power transmission members 62B and 62C are disposed so as to come into contact with the outer peripheral surface of the fixing belt 61. Accordingly, a driving force is transmitted to the fixing belt 61 from the pressure roller 62 even during a warm-up operation. Meanwhile, it is preferable that the power transmission members 62B and 62C come into contact with portions of the fixing belt 61 supported from inside by the fixing portions 67A. In this case, since deflection or distortion hardly occurs on the fixing belt 61, a rotational driving force is more stably transmitted to the fixing belt 61.

The foregoing description of the exemplary embodiments of the invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention is defined by the following claims and their equivalents.

What is claimed is:

1. A fixing device comprising:

a fixing member that is rotatably provided and heats an image formed on a recording material to fix the image to the recording material;

a contact member that moves the recording material positioned between the fixing member and the contact member by being rotationally driven while coming into contact with the fixing member, and is provided so as to be separated from the fixing member; and a rotating member that is mounted on the contact member, is disposed so as to come into contact with the fixing member while the contact member is separated from the fixing member, rotates while interlocking with the contact member, transmits a rotational driving force from the contact member to the fixing member, and rotates with respect to the contact member when the fixing member is rotated by an external force and a rotational driving force is transmitted to the rotating member from the fixing member.

2. The fixing device according to claim 1, further comprising:

a rotating mechanism that is provided between the rotating member and the contact member, the rotating mechanism rotating the rotating member with respect to the contact member when the rotating member rotates in a first direction, and the rotating mechanism rotating the contact member while making the contact member interlock with the rotating member when the rotating member rotates in a second direction opposite to the first direction, wherein the rotating member is rotated in the first direction by the fixing member and the rotating member idles with respect to the contact member through the rotating mechanism, so that the rotating member is rotated with respect to the contact member when a rotational driving force is transmitted to the rotating member from the fixing member.

3. The fixing device according to claim 2, wherein the contact member is rotationally driven in the first direction and the rotating member follows the contact member through the rotating mechanism, so that the rotating member rotates while interlocking with the contact member.

4. The fixing device according to claim 2, wherein when the contact member is rotationally driven while coming into contact with the fixing member, the contact member is rotationally driven in the second direction and the transmission of a rotational driving force to the rotating member from the contact member is cut off by the rotating mechanism.

5. The fixing device according to claim 1, further comprising:

an electromagnetic clutch that is provided between the rotating member and the contact member, wherein the electromagnetic clutch is controlled to release the connection between the rotating member and the contact member, so that the rotating member is rotated with respect to the contact member when a rotational driving force is transmitted to the rotating member from the fixing member.

6. A fixing device comprising:

a fixing member that is rotatably provided and heats a toner image formed on a recording material to fix the toner image to the recording material;

a contact member that moves the recording material positioned between the fixing member and the contact member by being rotationally driven while coming into contact with the fixing member, and is provided so as to be separated from the fixing member;

a transmission member that is mounted on the contact member, comes into contact with the fixing member while the contact member is separated from the fixing member, receives a rotational driving force transmitted from the contact member, and transmits the transmitted rotational driving force to the fixing member; and a cut-off unit that cuts off the transmission of a rotational driving force to the transmission member from the contact member when the contact member is rotationally driven while the contact member comes into contact with the fixing member.

7. The fixing device according to claim 6, wherein the transmission member is pressed against the fixing member and is rotated by the rotational driving force transmitted from the fixing member while following the fixing member when the contact member is rotationally driven while coming into contact with the fixing member.

8. The fixing device according to claim 6, further comprising:

a cut-off mechanism that is provided between the transmission member and the contact member, the cut-off mechanism transmitting a rotational driving force to the transmission member from the contact member when the contact member is rotationally driven in a first direction, and the cut-off mechanism cutting off the transmission of a rotational driving force to the transmission member from the contact member when the contact member is rotationally driven in a second direction opposite to the first direction, wherein the contact member is rotationally driven in the second direction when the contact member is rotationally driven while coming into contact with the fixing member, and the cut-off unit cuts off the transmission of the rotational driving force by the cut-off mechanism.

9. The fixing device according to claim 8, wherein when the contact member is separated from the fixing member and a rotational driving force is transmitted to the fixing member by the transmission member, the contact member is rotationally driven in the first direction and the transmission member follows the contact member by the cut-off mechanism, so that the rotating member rotates and a rotational driving force is transmitted to the fixing member by the rotating transmission member.

10. The fixing device according to claim 6, further comprising:

an electromagnetic clutch that is provided between the contact member and the transmission member, wherein the cut-off unit cuts off the transmission of the rotational driving force by the electromagnetic clutch.

11. An image forming apparatus comprising:

an image forming section that forms an image on a recording material;

a fixing member that is rotatably provided and heats the image formed by the image forming section to fix the image to the recording material;

a contact member that moves the recording material positioned between the fixing member and the contact member by being rotationally driven while coming into contact with the fixing member, and is provided so as to be separated from the fixing member; and a rotating member that is mounted on the contact member, is disposed so as to come into contact with the fixing member while the contact member is separated from the fixing member, rotates while interlocking with the contact member, transmits a rotational driving force from the contact member to the fixing member, and rotates with respect to the contact member when the fixing member is rotated by an external force and a rotational driving force is transmitted to the rotating member from the fixing member.

12. An image forming apparatus comprising:

an image forming section that forms an image on a recording material;

a fixing member that is rotatably provided and heats the image formed by the image forming section to fix the image to the recording material;

a contact member that moves the recording material positioned between the fixing member and the contact member by being rotationally driven while coming into contact with the fixing member, and is provided so as to be separated from the fixing member;

a transmission member that is mounted on the contact member, comes into contact with the fixing member while the contact member is separated from the fixing member, receives a rotational driving force transmitted from the contact member, and transmits the transmitted rotational driving force to the fixing member; and a cut-off unit that cuts off the transmission of a rotational driving force to the transmission member from the contact member when the contact member rotates while the contact member comes into contact with the fixing member.

* * * * *